United States Patent [19]

Horino et al.

[11] 4,376,364

[45] Mar. 15, 1983

[54] SHEET-LIKE MATERIAL SORTING APPARATUS

[75] Inventors: Shigeo Horino, Tokyo; Shoji Taniguchi, Yokohama; Hideo Omura, Tokyo, all of Japan

[73] Assignee: Tokyo Shibaura Denki Kabushiki Kaisha, Kawasaki, Japan

[21] Appl. No.: 175,015

[22] Filed: Aug. 4, 1980

[30] Foreign Application Priority Data

Aug. 9, 1979 [JP] Japan ..... 54-100771

[51] Int. Cl.[3] ..... B07C 5/10; G65H 7/12

[52] U.S. Cl. ..... 53/54; 53/139.3; 53/500; 53/587

[58] Field of Search ..... 53/54, 500, 498, 493, 53/52, 419, 139.3, 587; 209/534, 569, 583

[56] References Cited

U.S. PATENT DOCUMENTS 3,759,382 9/1973 Walkley et al. ..... 209/DIG. 2 X
3,932,272 1/1976 Carnes, Jr. et al. ..... 209/534
4,025,420 5/1977 Horino ..... 209/534 X
4,236,639 12/1980 Boettge et al. ..... 209/534

FOREIGN PATENT DOCUMENTS 54-111893 9/1979 Japan ..... 209/534
54-113399 9/1979 Japan ..... 209/534
2034286 10/1979 United Kingdom ..... 209/534

*Primary Examiner*—James F. Coan
*Attorney, Agent, or Firm*—Cushman, Darby & Cushman

[57] ABSTRACT

A given number of sheets are set to a supply section and, after being bundled, supplied from the supply section. The bundled portion of the bundled sheets is read out by a reading-out unit and a sorting card is prepared by a sorting card preparing unit on the basis of read-out data. The thus set sheets are taken out sheet by sheet by a take-out unit and sorted by an inspection unit and sorting unit into normal sheets, soiled sheets and reject sheets. The reject sheets are collected, together with the sorting card, at a reject sheet sorting/collecting unit.

9 Claims, 19 Drawing Figures

905
TEN-KEY
904
REJECT DISP.
903
TOTAL DISP.
DISPLAY CONTROL SECTION
1114
1115
OPERATION CONTROL SECTION
CLOCK GEN.
I/O PORT
1101
1103
1104
MICROPROCESSOR
MEMORY
1102
1100
906
START
211
1116
525
1117
1113
JOURNAL PRINTER
1112
RECORD CONTROL
300
SHEET INSPECTION DEVICE
1106
NORMAL COUNTER
1108
SOILED COUNTER
1110
TOTAL COUNTER
1105
COUNT CONTROL SECTION
1107
NORMAL COUNTER
1109
SOILED COUNTER
1111
TOTAL COUNTER
410
NORMAL DETECTOR
411
SOILED DETECTOR
409
TRUE DETECTOR

SHEET-LIKE MATERIAL SORTING APPARATUS

The present invention relates to a sheet-like material sorting apparatus which automatically inspects sheet-like material such as slips, share certificates, and checks and sorts them into effective sheet-like material and ineffective sheet-like material.

Recently, various types of sheet-like material sorting apparatuses have been developed and practically used which automatically inspects and sorts sheet-like material (referred to after sheet) into first or effective sheet-like material and second or ineffective sheet-like material. One of those apparatuses automatically counts the sheet-like material sheet by sheet to check the number of the material and at the same time to reject the ineffective sheet-like material which can not be inspected by the inspecting device, such as foreign sheets and invalid sheets, and further sorts the effective sheets into the normal sheets which are reusable and soiled sheets which are valid but unreusable, stacks those sheet-like material every 100 sheets, and finally bundles and stamps those unit sheet-stacks.

The conventional sorting apparatus sorts the sheet-like material every 1,000 sheets, that is, employs a called batch process for the sorting. The conventional apparatus can check whether the number of the sheets is satisfactory or not, or whether ineffective sheets are included or not in the sheet-like material now being processed. It is impossible to check what sheet-stack of those 10 stacks each including 100 sheets has an abnormal sheet or sheets. In the case of securities, 100 sheets are stacked and bundled by small strips, and the sheet-stacks of 10, totally including 1,000 sheets, are gathered and bundled by a large strip.

In general use of the conventional apparatus, the 1,000 sheets are handled in the same processing but the sheet-stacks each including 100 sheets are often handled by different persons. After those sheet-like material are processed, there frequently occurs a desire to know who has handled the unit sheet-stacks including abnormal sheet or sheets. To meet the desire, the sheets must be processed every 100 sheets in place of 1,000 sheets. In this case, checking the number of the sheets and processing the ineffective sheets are performed every 100 sheets, with the result that idle time of the apparatus increases to remarkably deteriorate efficacy of the sorting apparatus and to lessen the labor saving effect of the system. The sorting apparatus designed to process the sheets every 100 sheets, which has been proposed, needs an insertion thereinto of a sorting card by an operator. This makes the operation work by the operator complicated. Therefore, this proposal is impractical.

Accordingly, an object of the present invention is to provide a sheet-like material sorting system with lessened idle time and with a minimum increase of the work by an operator.

To achieve the object, the processing of the sheet-like material every 100 sheets is performed with a minimum idle time between the adjacent processings of each of the 100 sheets, eliminating the insertion work of the sorting card by an operator. Therefore, the sheet-like material sorting system performs the sorting operation effectively.

The present invention may be summarized by a sheet-like material sorting system involving a sheet-like material sorting apparatus including a supply section for supplying sheet-like material, a take-out section for sequentially taking out a sheet-like material supplied by the supply section sheet by sheet, an inspecting section for judging the taken out sheet-like material to sort them into first and second sheet-like materials, a sorting section for sorting the sheet-like material on the basis of the result of the judgement, and a collecting section for collecting the sorted sheet-like material, the improvement comprising: read means for reading the bundled portion of the sheet-like material supplied by the supply section, and card preparing means which prepares sorting cards in accordance with the information read out from the read means so as to be collected together with the second sheet-like material in the correcting section when the sorting of the bundled sheet-like material of a given number are completed.

The sheet-like material sorting system according to the invention mainly handles securities such as share certificates, checks and slips. The system supplies the unit sheet-stacks each containing 100 sheets to a sheet supply section as they stand. The sheet supply section reads the information marked on a small tape bundling the unit sheet-stack and breaks the small strip and transfers those sheets on a sheet-by-sheet basis to a succeeding processing stage of the system. During the course of the sheet transfer, features of the sheets is sensed and those sheets are sorted on the basis of the features sensed. Finally, the sorted sheets are bundled every given number of sheets.

Other objects and features of the invention will be apparent from the following description taken in connection with the accompanying drawings, in which.

Figure 1:
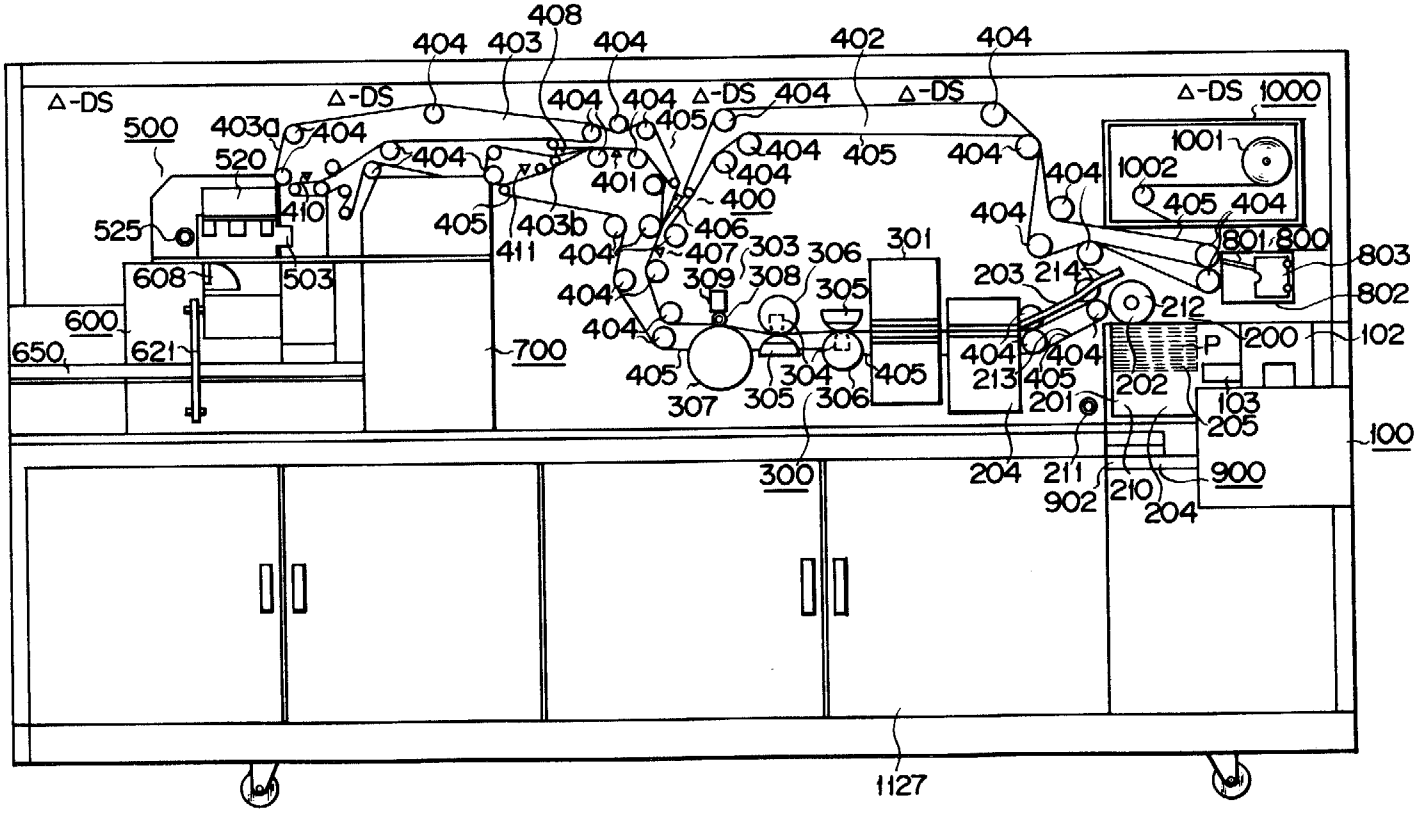
FIG. 1 is a schematic diagram of an overall sheet-like material sorting system according to an embodiment of the present invention.

Before proceeding with the description of the preferred embodiment of the invention, securities such as checks or slips to be handled by the sheet-like material sorting system of the invention will be referred to below. The security handled will be referred to as a sheet for simplicity.

I. First sheet:

This sheet is an effective sheet.

(a) Normal sheet: Sheet judged to be normal and available as the result of its inspection and after it is processed by the system, is used again in its field.

(b) Soiled sheets: Sheet judged to be normal and available as the result of its inspection and, after it is processed by the system, is collected by the issuing side and is discarded.

II. Second sheet:

This sheet is an ineffective sheet and referred to as a to-be-rejected sheet.

This sheet includes an invalid sheet, an unidentifiable sheet and a foreign sheet. The invalid sheet is the one judged to be false or invalid. The unidentifiable sheet is the one which can not be inspected for the reason that the sheet has a great scar or scars or is taken out in a state superposed with another sheet. The foreign sheet is a sheet different from the sheet to be processed by the system.

Of those securities sorted such as the normal sheets, the soiled sheets and the to-be-rejected sheets, the normal sheets are stacked into unit sheet-stacks each including 100 sheets. The soiled sheets are cut into a number of pieces by a cutting machine. The to-be-rejected sheets are collected in a collecting section for the to-be-rejected sheet.

The normal sheets sorted and stacked are transferred to as a 100-sheet-stack to the next station. At this stage, the 100-sheet-stack or unit sheet or unit sheet-stack is merely stacked but not yet bundled. Then, those unit sheet-stacks are bundled at the proper station. The bundling is performed in a manner that a bundling tape such as a paper tape is looped around the unit sheet-stack and the external end of the loop is bonded to the outer periphery of the wounded portion. The paper tape for bundling the unit sheet-stack will be called a small strip. The unit sheet-stacks bundled is transferred along a transfer path. In the midway of the transfer, the name of an operator, the date of the processing and the like are stamped on the small strip of the bundled unit sheet-stack. After the stamping, the normal sheet-stacks are collected. In the collection of the stacks, 10 stacks are collected and bundled into a larger bundle. This bundle of the 10 stacks will be called a large bundle.

The information recorded on the small strip bundling the sheets, when the bundled sheets is supplied to a supply section, is read out by a reading means. The information read is transferred to a sorting card preparing section where it is printed on a sorting card. Printed on the sorting card are the number of the normal sheets, and the number of the soiled sheets, as well as the read information such as the name of an operator, the date of the processing, and the like. The sorting cards thus prepared together with the to-be-rejected sheets, are collected in the collecting section for the to-be-rejected sheet, when the sorting of the sheets is completed.

An embodiment of the present invention will be described in detail hereinafter.

FIG. 1 is a front view of the sheet-like material sorting apparatus according to the invention.

The sorting apparatus is comprised of a supply section 100, take-out/transfer section 200, an inspection section 300, a transfer/sorting section 400, a sorting-/collecting section 500, a bundling section 600, a sheet-invalidating section 700, a to-be-rejected sheet collecting section 800, an operating section 900, a sorting card preparing section 1000 and its related mechanisms to be given later and a control unit for controlling those mechanical sections.

The supply section 100 accommodates a number of bundled unit sheet-stacks and reads the information marked on the small strip of each unit sheet-stack. The supply section 100 further breaks the small strips of the unit sheet-stacks and transfers them P to the take-out/-transfer section 200 in a piled state. The take-up/transfer section 200 takes out the sheets P transferred from the supply section 100 on the sheet-by-sheet basis by means of a vacuum means and transfers them to the inspection section 300. The inspecting section 300 performs a predetermined inspection about the sheets P from the take-out/transfer section 200. The transfer/-sorting section 400 sorts the sheets P passed the inspection section 300 from the take-out/transfer section 200 on the basis of the result of the inspection of the inspecting section 300, and transfers them to the sorting/collecting section 500, the sheet invalidating section 700 and the collecting section 800 for the to-be-rejected sheet. The sorting collecting section 500 sorts the normal sheets transferred from the transfer/sorting section 400 every 100 sheets and collects them in substantially horizontal state, and transfers the collected normal sheets to the bundling section 600. The bundling section 600 bundles the 100-sheet-stacks transferred from the sorting/collecting section 500 and transfers them to the outside of the section.

The constructions and operations of the respective sections will be described in detail hereinafter.

Figure 2:
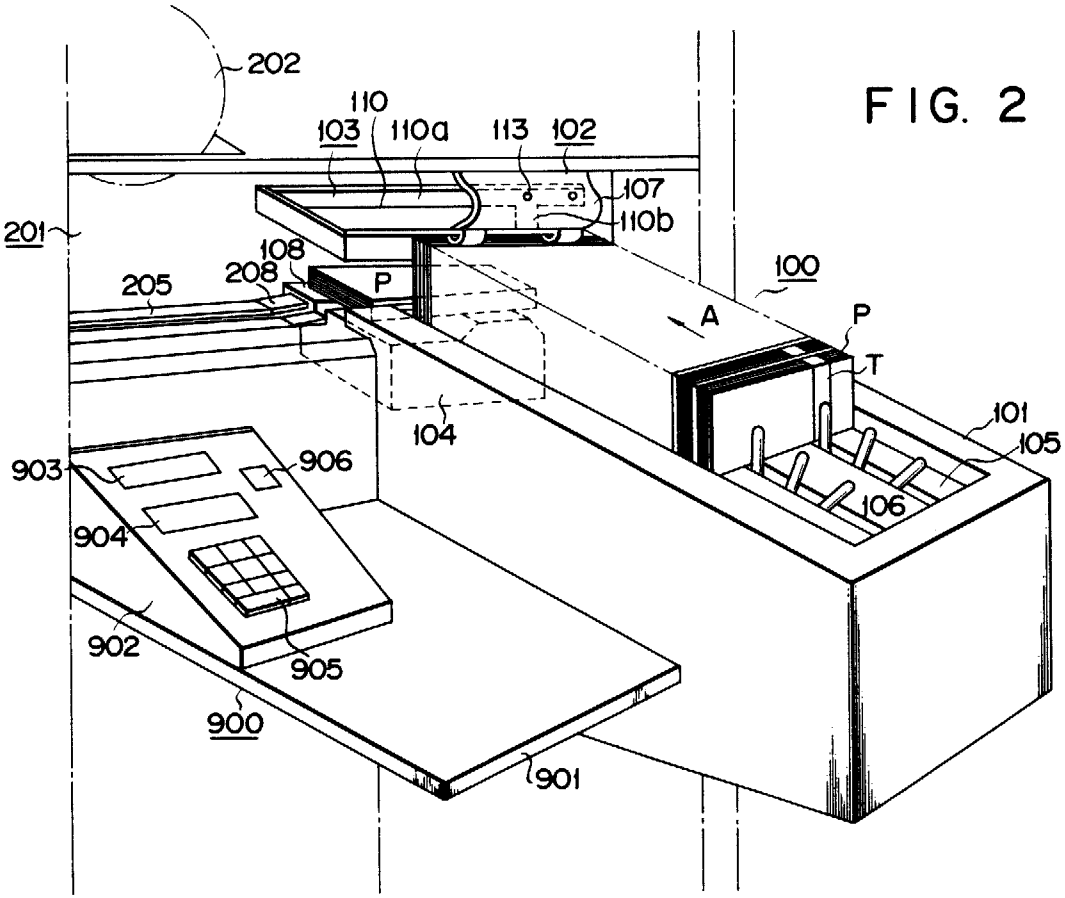
FIG. 2 is a perspective view an external view of a sheet supply section used in the embodiment shown in FIG. 1.
Figure 3:
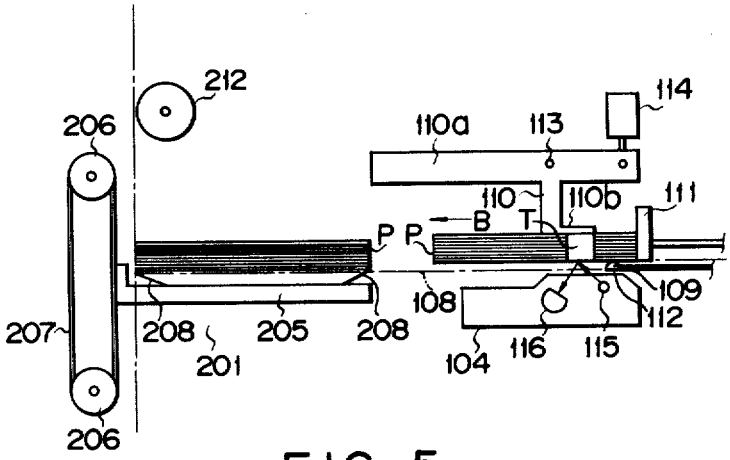
FIG. 3 is a schematic diagram of a strip breaking section and a sheet take-out section, which are used in the embodiment shown FIG. 1.

The supply section 100 is comprised of a bundle supply table 101, a unit sheet-stack supply mechanism 102, a strip breaking mechanism 103 and a read mechanism 102. The bundle supply table 101 holds the stacks, i.e. the sheet-stacks P bundled by the small strip T, in a depressed portion 105 in an upstanding state. The table 101 transfers pitch by pitch the sheet-stacks thus held by supporting while being supported by pins 106 planted on an endless belt (not shown) provided within the table 101 in a direction of an arrow A. The unit sheet-stack supply mechanism 102 is comprised of a plate spring 107 for pressing the sheet P from above, and a directing changing mechanism (not shown) for laying down horizontally the sheet P held in an upstanding state and places them on the read table 108. The strip breaking mechanism 103 is comprised of a cutter 109 for breaking the strip T bundling the sheets P, as shown in FIGS. 2 and 3, a remover 110 for removing the strip broken by the cutter 109 by firmly holding it, and a pushing plate 111 for pushing in arrowed direction of B the sheets P horizontally placed by the unit sheet-stack supply mechanism 102. The cutter 109 pushes up the sheets P by means of an arc spring 112 to separate the sheet-stack P and the small strip T to form a widened space therebetween, and then inserts an edge (not shown) into the widened space thereby to cut the small strip T. The cutter 109 reciprocately moves horizontally in FIG. 3. The remover 110 is comprised of a U-shaped frame **110*a* and arms 110*b* vertically extending from the legs of the U of the frame 110*a*. The frame 110*a* is swingable about a fulcrum 110*a* by means of a solenoid 114. The arm 110*a* have respectively nails oppositely disposed by which the small strip T is held squeezingly, and raises the strip while holding it by the nails with the operation of the solenoid 114 to separate the strip T from the sheet-stack T. The separated small strip T is removed from the arms 110*b* by a small strip remover mechanism (not shown). The pushing plate 111 moves reciprocately on the left portion in FIG. 3 to hook to the nails of the arms 110*b* in an arrowed direction B the strip of the sheet-stack P horizontally placed on the read table 108, which has supplied from the unit sheet-stack supply mechanism 102 stack by stack. The read table 108 is made of transparent material. The read mechanism 104 includes a lamp 115 for illuminating the strip T through the read table 108 and an image sensor 116 for converting into an electric signal the reflected light from the strip T which illuminated by the lamp 115**.

The operation of the supply section 100 thus constructed will be described hereinafter.

An operator places the unit sheet-stack P bundled on the sheet-stack supply table 101. At this time, the sheet-stack P placed supportingly between the pins 106 is fed in an arrowed direction A pitch by pitch. The sheet-stack P on the leading section of the arrowed direction A is pressed by a plate spring 107 and is further fed in the direction A. When the next sheet-stack P is pressed by the plate spring 107, the sheet-stack P on the leading portion is turned horizontally by the direction changing mechanism (not shown) and placed on the read table 108. Following this, the push plate 111 moves in the direction B to push the horizontally turned sheet-stack P. As a result, the small strip T bundling the strip P is held by the arms **110*b* of the strip breaking mechanism 103. Then, the cutter 109 moves in the direction B. With the movement of the cutter 109, the arc spring 112 slides along the lower surface of the sheet P to push up this and to form a space between the sheet-stack P and the small strip T. Then, the edge (not shown) is inserted into the space to break the small strip T. After the breakage, the cutter 109 returns to the initial state. Then, the solenoid 114 operates to rotate the frame 110*a*. Accordingly, the arms 110*b* is raised while holding the small strip T, so that the strip T is separated from the sheet P. The small strip T held by the arms 110*b* is removed therefrom in the manner as mentioned above. Then, the frame 110*a* is returned to its initial state. Then, the push plate is moved in the arrow B direction to move the sheet-stack P toward the take-out/transfer section 200**.

When the sheet-stack P is placed on the read table 108, the lamp 115 simultaneously is lit to illuminate the small strip T. The illuminating light is reflected by the small strip T and the reflected one is received by an image sensor 116. The image sensor 116 is an optical read element of the self-scan type such as a charge coupled device, and reads out the information such as the name of an operator, the date of the sheet processing and the like recorded on the small strip T. The read data is converted into a corresponding electrical signal. The electrical signal is applied as a read signal to the sorting card preparing section 1000.

The take-out/transfer section 200 is comprised of a supply stage 201, a take-out stage 202, a transfer stage 203 and a cleaner stage 204. The supply stage 201, coupled with the supply section 100, is provided with a sheet pressure plate 205 which vertically moves within the supply stage 201. The pressure plate 205 pushes upwardly the unit sheet-stack P while carrying it thereon, and pushes it toward the take-out stage 202. The sheet pressure plate 205 is mounted to an endless belt 207 wound around pulleys 206. The pressure board 205 vertically moves with the rotation of the belt 207. Spring members 208 are provided at both ends of the pressure board 205 to enhance the pressure effect of the sheet P (FIG. 3). A transparent cover 209 is provided on the front of the supply stage 201 and a reference surface 210 is provided in opposition to the cover 209, which the reference surface holds the rear end surface of the sheet-stack P from the rear side of the apparatus. The reference surface 210 slides back and forth by operating a sheet kind setting dial 211. The sheet kind setting 211 is used for setting a kinds of the sheet handled by the apparatus. The apparatus of this embodiment handles three kinds of sheets X, Y and Z with different widths and lengths. Accordingly, the reference surface 211 slides back and forth a distance defined by the width of the sheet P.

The take-out stage 202 is comprised of a rotor 212 rotating clockwise and a suction chip (not shown) provided around the rotor 212. The rotor 212 is rotated clockwise by a drive source (not shown). The suction chip has a thickness gradually decreasing in the rotating direction of the rotor 212, having a smoothed surface. A suction hole (not shown) communicating with a vacuum means (not shown) is provided on the surface of the suction chip.

Transfer stage 203 transfers the sheet-stack taken out by the take-out stage 202 to the transfer/sorting section 400 and is comprised of a take-in path 213 and a guide plate 214. A cleaner stage 204, which communicates with the vacuum means (not shown) sucks to remove dust attached to the sheet-stack P carried by the transfer/sorting section 400 thereby to reduce the effect of the dust upon the inspection of the succeeding inspecting section 300.

The operation of the take-out/transfer section thus constructed will be described. Firstly, the sheet kind setting dial 211 is turned to set a kind of the sheet to be handled, so that the reference surface 210 moves to set the width of the sheet to be handled. Under this condition, the pile of the sheet-stacks transferred from the supply section 100 is positioned from three directions by the vertical portion on the left side of the sheet pressure plate 205, the reference plate 210 and the pressure plate 111.

Then, the sheet-stack pressure plate 205 rises carrying the pile of the sheet-stack P to press upwardly the sheet-stacks at a fixed pressure. At the same time, the pressure plate 108 shifts to the right and is set at a fixed position within a supply chamber 106. As a result, the rotor 212 rotates clockwise and the suction chip (not shown) attracts the uppermost sheet-stack P within the supply stage 201 and transfers the sheet-stack P to the receiving stage 203. The sheet-stack P taken out is transferred along the take-in path 213 to the cleaner stage 204 where it is cleaned and then is transferred to the inspecting section 300.

While the sheet P set within the supply stage 201 is taken out by the take-out stage 202, the next sheet-stack P is supplied within the supply section 100 where the information on the small strip T is read. Upon the completion of the small strip T read within the supply stage 201, the sheet-stack P on the read table 108 is transferred to the supply section 201. In this way, the sheet-stacks are continuously taken out.

The inspecting section 300 (see FIG. 1) is comprised of an optical inspecting stage 301, a magnetic inspecting stage 302, and a mechanical inspecting stage 303. In the optical inspecting stage 301, a visible light, for example, is illuminated onto the sheet-stack P and the reflecting and transmitted light rays from the sheet-stack P are processed with a proper logic thereby to detect an optical feature of the sheet-stack P. The magnetic inspecting stage 302 detects a magnetism of the sheet-stack to sense a magnetic feature of the stack P. The inspecting stage 302 is comprised of magnetic heads 304 and 304, a couple of pressure pads 305 and 305 for pressing the sheet P against the magnetic heads 304 and 304, and a couple of holding rollers 306 and 306 for holding the transfer belt of the transfer/sorting section 400 in zigzag fashion. The pressure pads 305 and 305 are disposed flush with the magnetic heads 304 and 304. The sheet-stack P is made to closely contact with the head surfaces of the magnetic heads 304 and 304 in a manner that the transfer belt of the transfer/sorting section is projected toward the pressure pads 305 and 305 by means of the holding rollers 306 and 306 and the sheet-stack P is pressed against the magnetic heads 304 and 304 by the pressure pads 305 and 305. Accordingly, a good magnetic-electric conversion is ensured.

The mechanical inspecting stage 303 detects whether the superposedly taken out sheets or foreign sheets are present or absent by detecting the thickness of the sheet-stack P. The inspecting stage 303 is comprised of a reference roller 307 fixedly disposed with the peripheral surface being invariable in position, a swing roller 308 to press the sheet-stack P being transferred against the reference roller 307, and a sensor 309 for sensing a displacement of the swing roller 308 optically, for example. The sensor 309 senses a displacement of the swing roller 308 when a sheet P thicker than the normal sheet P as a reference intervenes between the reference roller 307 and the swing roller 308. Specifically, the reference roller 307 is a tubular member as one piece with the smoothed peripheral surface. The swing roller 308 is a group of small rollers disposed in opposition to the reference roller 307. The small rollers 307 are disposed along the axis of the reference roller 307 at the positions to sense the thickness of the sheet-stack P. The sensor 309 includes a plurality of sensing elements for sensing the displacement of the swing roller 308 which are disposed corresponding to the swing rollers 308.

Figure 4:
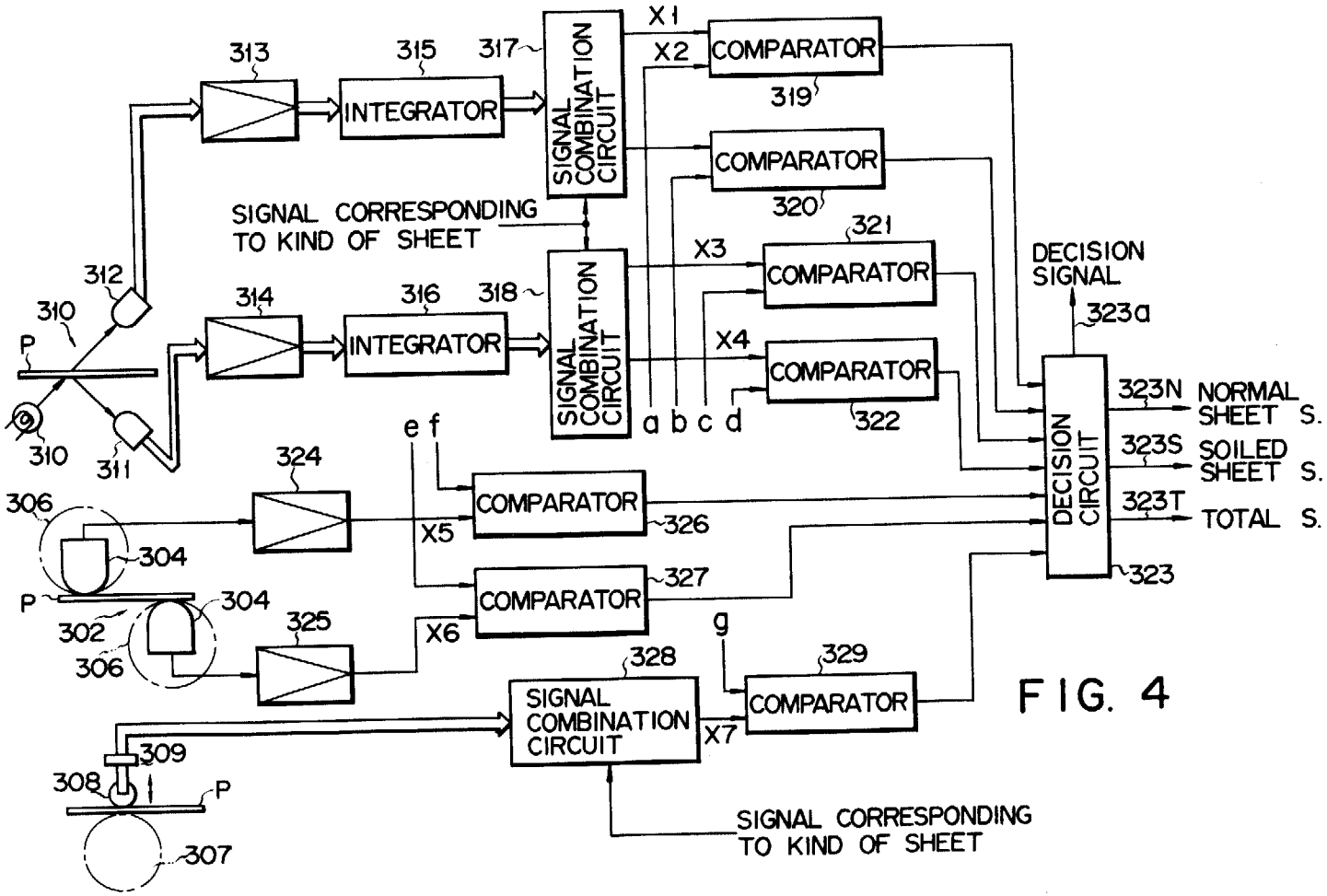
FIG. 4 is a block diagram of a circuit construction of an inspecting section used in the embodiment shown in FIG. 1.

The sheet inspection device 300 will further be described referring to FIG. 4. The optical inspection section 301 is comprised of a light source 310 for illuminating the sheet P, a light receiving element 311 for receiving the light reflecting from the sheet P, and a light sensing element 312 for receiving the light transmitted through the sheet. Actually, the light receiving elements 311 and 312 are provided at the positions for sensing an optical feature of the sheet P; however, these are illustrated generally as the receiving elements 311 and 312, for simplicity of illustration. With this arrangement, both the light receiving elements 311 and 312 convert the reflecting light and the transmitted light into corresponding electric signals, respectively. Those electric signals are transferred to the amplifiers 313 and 314, respectively. The amplifier 313 and 314 amplify the signals from the light receiving elements 311 and 312 to given signal levels and then transfer them to integrators 315 and 316, respectively. Upon receipt of the output signals (analog signals) from the amplifiers 313 and 314, the integrators integrate for a given time and then apply them to signal combination circuits 317 and 318, respectively. In response to a sheet kind setting signal representing a kind of the sheet P to be inspected, the signal combination circuits 317 and 318 respectively combine the plurality of the output signals from the integrators 315 and 316, on the basis of a given combination. The signals produced from these combination circuits 317 and 318 are an analog signal X1 formed on the basis of transmitted light from the sheet P for inspecting a degree of dirt of the sheet P, an analog signal X2 formed on the basis of the transmitted light from the sheet P for inspecting as to if the sheet is false or not, an analog signal X3 formed on the basis of the reflecting signal from the sheet P for inspecting a degree of dirt of the sheet P, and an analog signal X4 formed on the basis of the reflecting light from the sheet P for inspecting as to if the sheet P is false or not. Those signals X1 to X4 are transferred to comparators 319 to 322 where those are compared with a, b, c and d, respectively. The reference signals a to d are analog signals having signal levels representing the kinds of the sheets P to be inspected. Of those signals, the reference signals b and d have the given widths b1 to b2, and d1 to d2, respectively. The results of the comparisons by the comparators 319 to 322 are transferred to a decision circuit 323.

The magnetic heads 304 and 304, respectively, detect the magnetism developed from the obverse and reverse sides of the sheet P, and convert them into corresponding electric signals. These electric signals converted are applied to the corresponding amplifiers 324 and 325, respectively. The amplifiers 324 and 325 amplify the signals derived from the magnetic heads 304 and 304 to given signal levels, respectively. Those amplified signals X5 and X6 are further applied to the comparators 326 and 327. Upon receipt of those signals, the comparators 326 and 327, respectively, compare those signals with the reference signals e and f. The reference signals e and f are analog signals with the levels corresponding to a kind of sheets to be processed and have the given widths e1 to e2 and f1 to f2, respectively. The results of the comparisons by the comparators 326 and 327 are transferred to the decision circuit 323.

The oscillatory roller 308 responds to the thickness of the sheet P to be inspected to displace vertically. A displacement in excess of a given value causes the sensor 309 to operate, with a recognition that the sheets P are superposedly taken out and a foreign sheet is present. As a result, the sensor 309 produces a sensing signal corresponding to the displacement, which in turn is transferred to the signal combination circuit 328. The signal combination circuit 328 as a kind of a gate circuit responds to the sheet kind setting signal to combine the signals from the sensor 309 on a given combination and to produce the analog signal X7 representing the thickness of the sheet P. The signal X7 is transferred to the comparator 329 where it is compared with a reference signal g which is an analog signal with a level inherent to the kind of the sheet P to be inspected and has a width ranging between g1 to g2. In this way, the comparator 329 transfers the comparison result as a signal representing an abnormal thickness of the sheet P to be inspected (for example, the superposedly taken out sheet or the foreign sheet) to the decision circuit 323.

The reference signals a to g are generated from a reference signal generator (not shown), corresponding to the respective sheet kinds setting signals. The reference signal generator may be an analog memory for selectively producing an analog signal in accordance with the sheet kind setting signal or the combination of a fixed memory addressed by the sheet kind setting signal and a D/A converter for converting a digital signal derived from the fixed memory into an analog signal. The sheet kind setting signal is produced when the sheet setting dial 211 (FIG. 1) is operated and indicates what kind of sheet P is now processed by the apparatus now.

The decision circuit 323 decides the sheet P as in the following table on the basis of the comparison results of the comparators 319, 320, 321, 322, 326, 327 and 329.

TABLE

| DECISION PRIORITY | SHEET CLASSIFICATION | | CONDITIONS TO BE SATISFIED |
|---|---|---|---|
| 1 | SHEETS TO BE REJECTED | INVALID SHEET | X2>b2, OR b1>X2, OR X4>d2, OR d1>X4, OR X5>e2, OR X5<e1, OR X6>f2, OR X6<f1 |
| | | OVER-LAPPED SHEET FOREIGN SHEET | X7>g2, OR X7<g1 |
| 2 | SOLID SHEET | | b1≦X2≦b2, AND d1≦X4≦d2, AND e1≦X5≦e2, AND f1≦X6≦f2, AND g1≦X7≦g2, FURTHER X1<a OR X3<C |
| 3 | NORMAL SHEET | | X1≧a, AND b1≦X2≦b2, AND X3≧C, AND d1≦X4≦d2, AND e1≦X5≦e2, AND f1≦X6≦f2, AND g1≦X7≦g2 |

The decision circuit 323 judges the sheets P to decide the classes of the sheets P and produce various signals; a decision signal 323*a*, a soiled sheet signal 323S representing a soiled sheet, a normal sheet signal 323N representing a normal sheet, and a total signal 323T representing the total of the normal and soiled sheets. The decision signal 323*a* is used as a transfer and classifying control signal of the sheets P. The soiled, normal and total signals 323N, 323S and 323T are used as count signals respectively. The respective signals derived from the decision circuit 323 are transferred to a control device (FIG. 10) to be described later.

TRANSFER AND CLASSIFYING

The transfer and classifying device 400 (see FIG. 1) is mainly comprised of a first transfer path 401, a second transfer path 402, and a third transfer path 403. Those transfer paths includes each drive or follower rollers 404, 404, . . . and transfer belts 405, 405, . . . wound around those rollers. The transfer sheet P is nipped by the surfaces, confronting with each other, of the transfer belts 405, 405, . . ., and is transferred to the succeeding stage. The first transfer path 401 extends through the sheet receiving section 203, the sheet cleaner section 204 and the sheet inspection device 400. The second transfer path 402 is provided at its branching point with a first classifying gate 406. The first classifying gate 406, so designed to swing when it is driven by a rotary solenoid (not shown), guides the sheet P transferred from the inspection device 300 in response to the decision signal 323*a* (FIG. 4) to the second transfer path 402 or the third transfer path 403. A detector such as an optical detector is provided preceding to the first classifying gate 406. The detector 407 detects the sheet P transferred through the first transfer path 401 and produces a detecting signal. At the time that the detecting signal is produced, the first classifying gate 406 is swung.

The end portion of the second transfer path 402 is positioned above the sheet supply section 201. At the end portion, a rejected sheet pile-up section 800 is provided which includes a guide plate 801 coupled with the end portion of the second transfer path 402, a sheet pile-up or stacking box 802 for piling up or stacking rejected sheets P falling guided by the guide plate 801, and a door 803 for opening and closing the front opening of the sheet stacking box 802. The third transfer path 403 is comprised of a normal sheet transfer path 403*a* and a soiled sheet transfer path 403*b*. At the branching point of both the transfer paths 403*a* and 403*b*, a second classifying gate 408 is provided. The second classifying gate 408, constructed like the first classifying gate 406, responds to the decision signal 323*a* (FIG. 4) to guide the sheet P transferred from the inspection device 300 to the normal sheet transfer path 403*a* or the soiled sheet transfer path 403*b*. Also preceding to the second classifying gate 408 is provided an optical, for example, detector 409. The detector 409 detects the sheet P transferred through the third transfer path to produce a detecting signal. At the timing of the production of the detecting signal, the second classifying gate 408 is swung. The normal sheet transfer path 403*a* extends up to a normal unit sheet-stack forming device 500. An optical, for example, detector 410 is provided on the sheet take-in side of the unit sheet-stack forming device 500. The soiled sheet transfer path 403*b* likewise extends up to the sheet-invalidating section 700 and an optical, for example, detector 411 is installed at the sheet taken-in port side of the sheet-invalidating section 700. The detectors 410 and 411 detect the number of the sheets P transferred into the unit sheet-stack forming devices 400 and the sheet-invalidating section 700 and the timing of the sheet transfer. The detail of those unit sheet-stack forming devices will be described later.

The operation of the sheet transfer and classifying device 400 will be described in detail. The sheet P taken out by the sheet take-out/transfer device 200 is transferred to the transfer classifying device 400, through the sheet receiving section 203. Specifically, the sheet P is transferred from the sheet receiving section 203 to the first sheet transfer path 401. During the time period that the sheet travels on the first sheet transfer path, the sheet P is inspected by the inspection device 300 and the judging result or decision signal 323 (FIG. 4) corresponding to the class of the sheet P is produced from the decision circuit 323*a* (FIG. 4). The decision signal 323*a* is transferred to a control device (FIG. 10) to be described later. As the sheet P transferred is detected by the detector 407, the signal from the detector is applied to the control device (FIG. 10). Upon receipt of the decision signal 323*a* from the decision or judging circuit 323 (FIG. 4), the control device causes the first classifying gate 406 to swing. The first classifying gate 406, so set as to guide the sheet P to the third transfer path 403, holds the state set when the decision signal 323*a* from the decision circuit 323 represents a normal or a soiled sheet, and swings so as to guide a rejected sheet P to the second transfer path 402 when the decision signal 323*a* represents a rejected sheet at the timing that the sheet P is detected. The sheet P guided to the second transfer path 402 is accommodated in the sheet pile-up box 802 of the rejected sheet stacking section 800. The sheets P stacked or piled up in the box 802 may be taken out to exterior by opening the door 803.

When the sheet P is guided to the third transfer path 403 and detected by the detector 409, a detecting signal is produced by the detector and is transferred to the control device (FIG. 10). The control device causes the second classifying gate 408 to swing in response to the decision signal 323a from the decision circuit 323. Specifically, the second classifying gate is set in a normal condition so as to guide the sheet P to the normal sheet transfer path 403a. When the decision signal 323a represents a normal sheet, such a set condition is held as it is. When the decision signal 323a represents a soiled sheet, the second gate is rotated so as to guide the sheet P at the timing of the detection of the sheet P.

Though not illustrated, optical jam detectors are provided with given intervals in the transfer/classifying device 400. The jam detectors detect the presence or absence of the passing sheet P thereby to check jam and the drop-out of the sheet from the sheet transfer path.

UNIT SHEET-STACK FORMING

Figure 5:
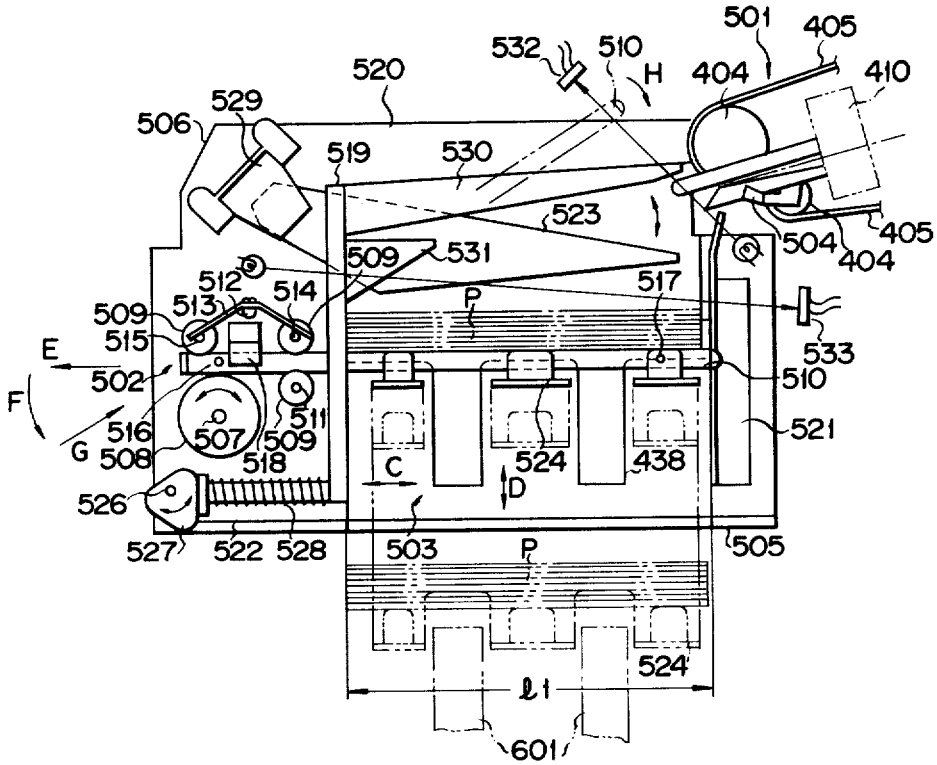
FIG. 5 is a front view of a construction of a sorting-/collecting section of the embodiment shown in FIG. 1.

The stack forming device 500 is roughly divided into a sheet take-in section 501, a separator 502, and a stack forming section 503 (FIG. 5). The sheet taken-in section 501 is comprised of a detector 410 for detecting the sheet P transferred from the normal sheet transfer path 403a (FIG. 1), a roller 404 for transferring the sheet P, a transfer belt 405 wound around the roller, and a charge remover 504 for removing the charge charged on the sheet P through the slide of it along the sheet P. The detector 410 detects the passing of the sheet P to detect the number of the sheets passed and the timing of the transferring sheet taken in. The roller 404 and the transfer belt 405 constitute a part of the normal sheet transfer path 403a. The normal unit sheet-stack forming device 500 is supported by subplates 506 upstanding from a base member 505. The separator 502 is comprised of a drive roller 508 (not shown) mounted to a shaft 507 supported by the subplate 406, follower rollers 509 supported by brackets (not shown), separator arm 510 nipped by the drive roller 508 and the follower rollers 509. The shaft 507 is rotatably coupled with a motor (not shown) to be rotated thereby. Grooves (not shown) for stably supporting the separator arm 510 is formed on the peripheral surface of the drive roller 508. Similarly, grooves are formed on the peripheral surfaces of the follower rollers 509.

The brackets (not shown) described above are supported by the shaft 307, allowing the brackets to be rotatable about the shaft 507. A shaft 511 is bridged between the brackets and rotatably supports the lower-follower roller 509. Above the shaft 511 a shaft 512 is bridged between the brackets. A curved plate spring 513 is rotatably mounted to the shaft 512. Shafts 514 and 515 are fixed to both ends of each plate spring 513. The upper right-follower roller 509 is rotatably mounted to the shaft 514 and the upper left-follower roller 509, to the shaft 515. Thus, the brackets (not shown) and the plate spring 513 is rotatable and therefore the upper-follower rollers 509 are swingable with respect to the drive roller 508, and the lower-follower roller 509. The bracket supporting the rollers 508, 509 are normally biased toward the base member 505 by means of a coiled spring (not shown). Further, to the brackets, a pawl (not shown) is screwed. The pawl engages an armature (not shown) which is moved by the attraction or the release by the solenoid (not shown), when the brackets are rotated counterclockwise against the tension of the spring (not shown).

The separate arms 510 as metal bars has one end curved. Of those separate arms 510 are provided at the forward and backward ends with stopper pins 516 and 517. The stopper pins 516 and 517 defines the movable range of the separator arms 510. The stopper pins 516 and 517 are fixed by means of fixing members 518.

Included in the unit sheet-stack forming section 503 are: slide stoppers 519 as the respective side walls, a transparent plate for covering the front of the unit sheet-stack forming section 503, a vibrating plate 521, a mechanism 522 for changing a sheet stacking capacity by moving the slide stopper 519 and the plate 520, a vibrating mechanism 522 for vibrating the plate 521, beating member 523, and a back-up member 524 serving as the bottom, and the like. The mechanism 522 for changing the sheet stacking capacity changes the sheet stacking capacity in accordance with the size of the sheet P to be processed. When the sheet to be processed is set to a given size by rotating a knob 525 (see FIG. 1), a cam 527 fixed to the shaft 526 coupled with the knob 525 rotates, so that the slide stopper 519 moves through a moving member 528 in a C direction arrowed, thereby to obtain a given length $l_1$ in the longitudinal direction (longer side) of the sheet P. Also when the slide stopper 519 moves, a cam (not shown) fixed to the stopper 519 is also moved in the arrowed C direction. With the movement of the cam (not shown), the plate 520 moves back and forth thereby to obtain a given length $l_2$ in the shorter side (width) direction of the sheet P.

Fixed to the shaft 526 is a disc (not shown) for detecting the size set of the sheet. The disc has slits on the peripheral surface. Those slits are detected by detectors (described later) disposed around the disc, optically. The respective output signals from the detectors are transferred to the control device described later whereby the size of the sheet P, as set, is detected.

The vibrating mechanism (not shown) vibrates vibrating plates 521 to arrange the stacked sheets properly.

The beating member 523, fixed to the housing 529, are used to slap the sheet P incoming through the transfer section 501 to let it fall. The beating member 523 is coupled with a rotary solenoid (not shown). The beating member 523 is swung with a given stroke by means of the solenoid at high speed. Reference numerals 530 and 531 are guide members for guiding the incoming sheet P, which are fixed to the upper end of the slide stopper 519. The slide stopper 519 and the beating members 523 are coupled in a telescopic manner between the housing 529. The guide members 530 and 531 are moved in the X direction with the movement of the slide stopper 519. The back-up member 524 are shaped like an inverse L. The horizontal portion of the inverse L is divided into three. The back-up member 524, disposed under the separator 510, piles up thereon the sheets P and is movable up and down, if necessary.

The operation of the normal unit sheet-stack forming device thus far described in detail relating to its construction will be given. The sheet P coming in through the sheet take-in port is successively guided by the guide members 530 and 531, and is beaten to drop by the beating member 523, so that those sheets P are piled up on the separator 502 disposed within the unit sheet-stack forming section 503, successively. When the sheets P approximate to the given number are piled up on the separator 502, the separator 502 retards in an arrowed direction E. Specifically, the motor (not shown) operates to rotate the drive roller 508, so that the separator arm 510 moves to the left, or in the arrowed direction E in FIG. 5. After the separator 510 retards, the sheets P piled up in the separator are dropped due to their own weights on the back-up plate 524 which has been lifted to a position indicated by a continuous line and ready for receiving the falling sheets. At this time, the separator 502, which retarded in the arrowed direction E, swings counterclockwise i.e. in the arrow direction F, to change its angle. Afterwards, it advances in the arrow direction G and retards to a position (FIG. 5) indicated by a two-dot chain line and is on stand-by. That is, when the separator arm 510 moves in the arrow direction E and the stopper pin 516 provided at the end comes in contact with the engaging member 518, the separator arm 510 swings in the arrow direction F. The swing is stopped to be locked when the pawl engages the armature. Upon the locking those separator arm 510, the drive roller 508 rotates, so that the separator arm 510 moves in the arrow direction G. Then, when the stopper pin 516 comes to engage the engaging member 518, the drive roller 508 stops its rotation.

In this way, when the sheets P approximate to the given number (, for example, 100) are piled up on the back-up member 524, the back-up member 524 descends to the position (FIG. 5) indicated by one-dot chain line. Then, when the given number of sheets P is stacked on the back-up member 524, the separator 502, which has been on stand-by above the unit sheet-stack forming section 503, rotates clockwise, i.e. in the arrow direction H to stop again at the position indicated by a continuous line. Specifically, when the 100th sheet P is detected by the detector 410, the control device shown in FIG. 10 receives a detecting signal from the detector 410 to apply a drive signal to the solenoid, so that the engagement of the armature with the pawl is released. Therefore, the separator arm is unlocked and the tension of the spring causes the separator arms to drop (rotate). Accordingly, the sheet P on the back-up member 524 is perfectly separated from the successively transferred sheets P, by means of the separator 502. The number of the sheets P stacked on the back-up member 524 is counted by the control device shown in FIG. 10 on the basis of the output signal from the detector 410. Whether those sheets P are separated into the given number of them or not is optically checked by the detectors 532, 533 (see FIG. 5). In other words, when the detector 532 detects the 101st sheet P, if the detector 533 have been changed from "dark" to "bright", it is assumed that the sheets P have been separated with an accuracy of the given number of sheets. The back-up plate 524 descends from the position indicated by the one-dot chain line to the position (FIG. 5) by the two-dot chain line, while bearing the given number of the stacked sheets P. The sheet-stack will be called a unit sheet-stack. Then the unit sheet-stack is transferred to rotatable drums of the unit sheet-stack bundling device 600 (FIG. 1). After the transfer of the unit sheet-stack, the back-up plate 524 ascends again up to the position indicated by the continuous line (FIG. 3).

UNIT SHEET-STACK BUNDLING

Figure 6:
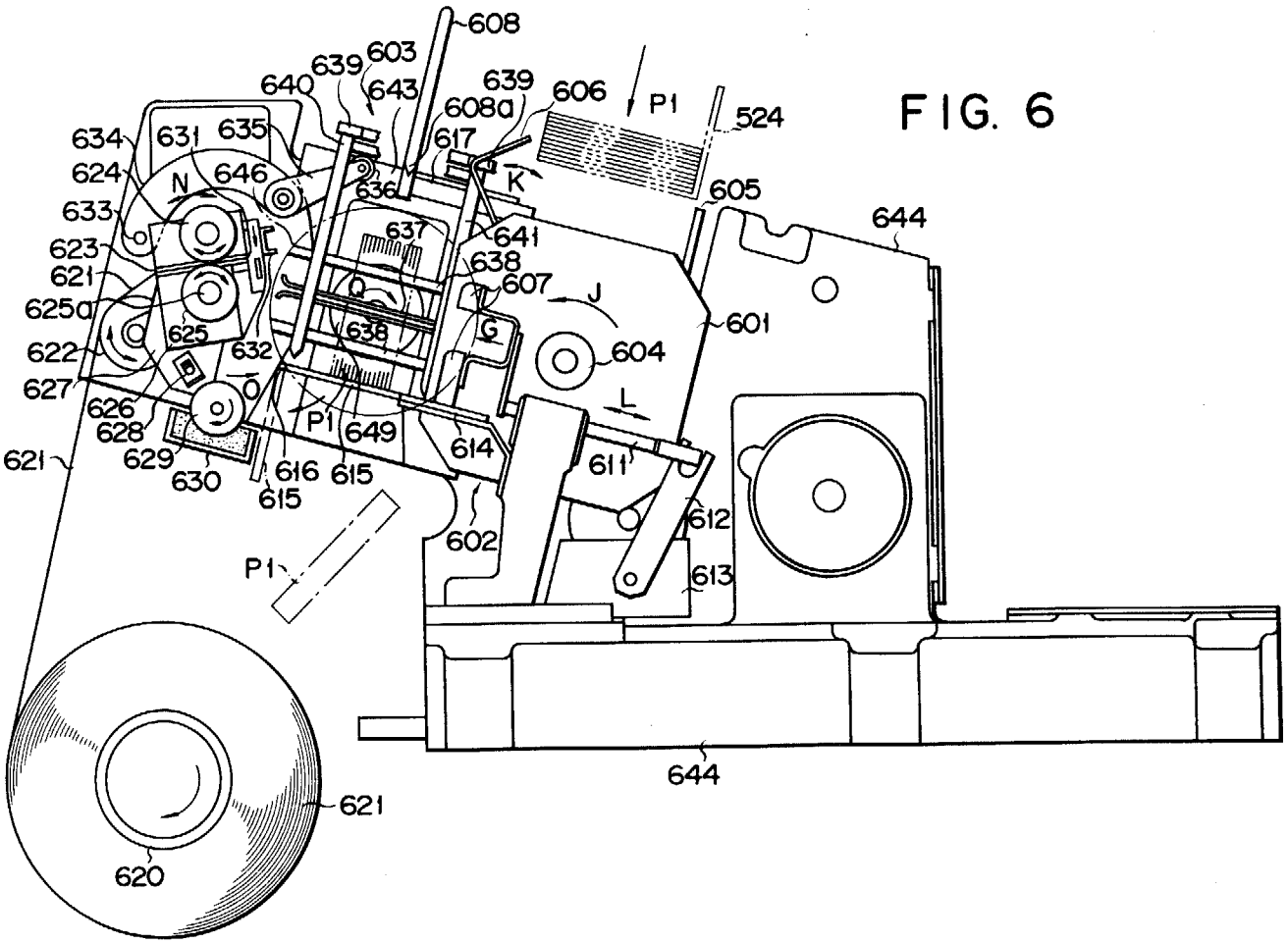
FIG. 6 is a side view of a detailed construction of bundling section of the embodiment shown in FIG. 1.
Figure 7:
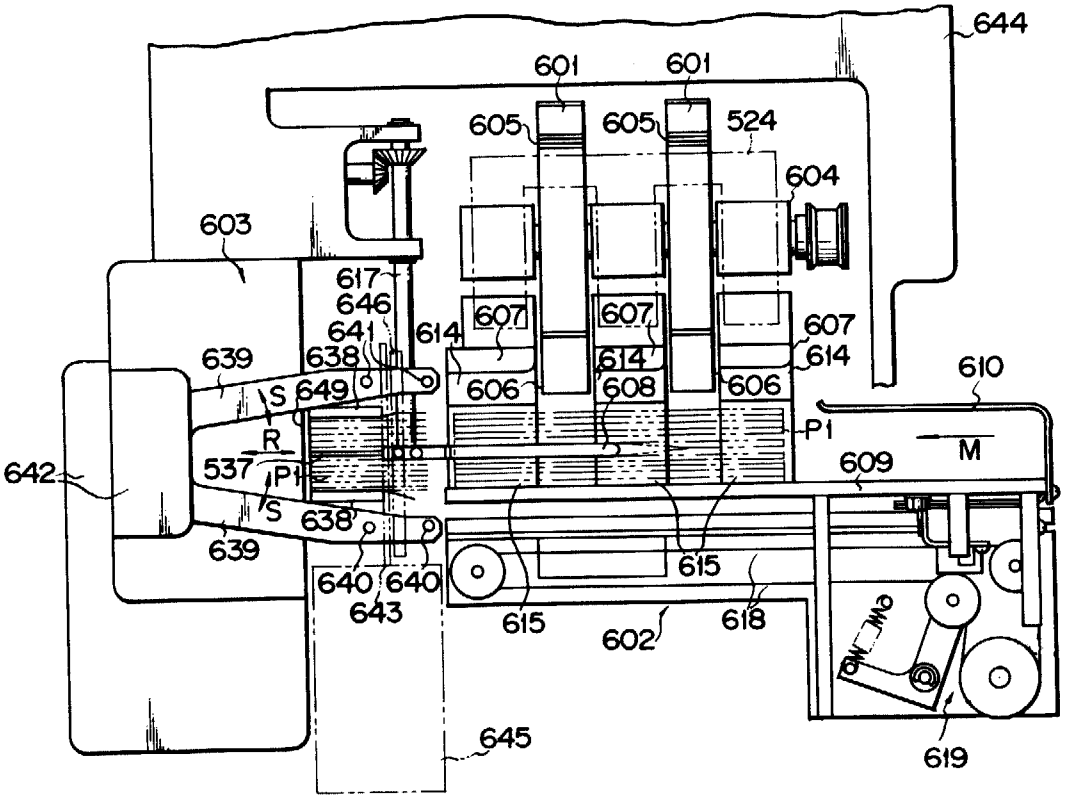
FIG. 7 is a plan view of the bundling section shown in FIG. 6.
Figure 8A:
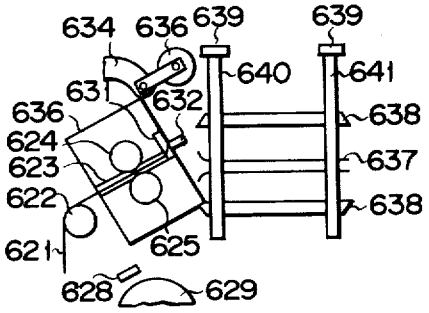
FIGS. 8A to 8I are schematic diagrams of a bundling tape loop forming mechanism and a unit sheet-stack bundling mechanism, which are used in the bundling section shown in FIGS. 6 and 7.
Figure 8B:
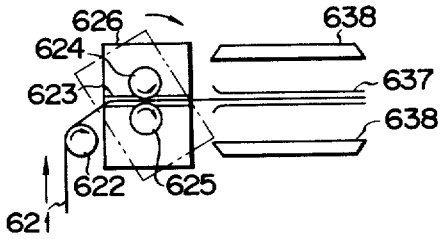
Figure 8C:
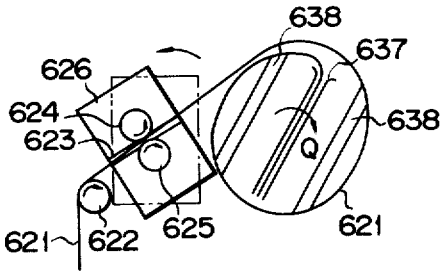
Figure 8D:
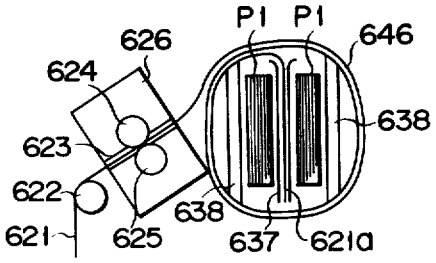
Figure 8E:
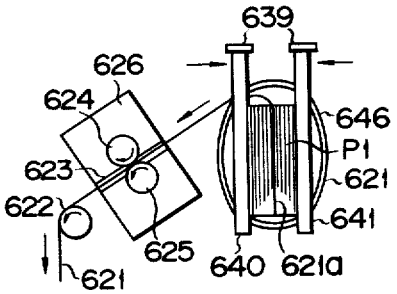
Figure 8F:
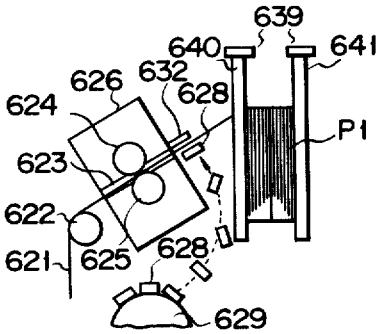
Figure 8G:
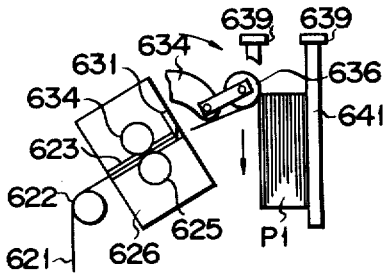
Figure 8H:
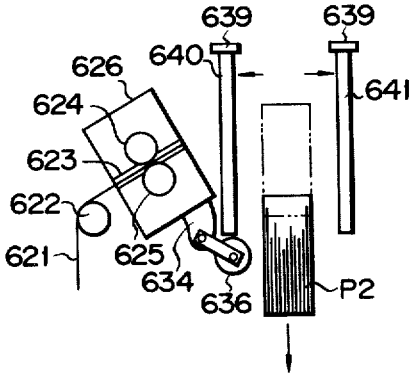
Figure 8I:
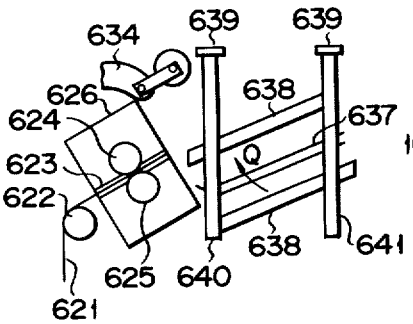
Figure 9:
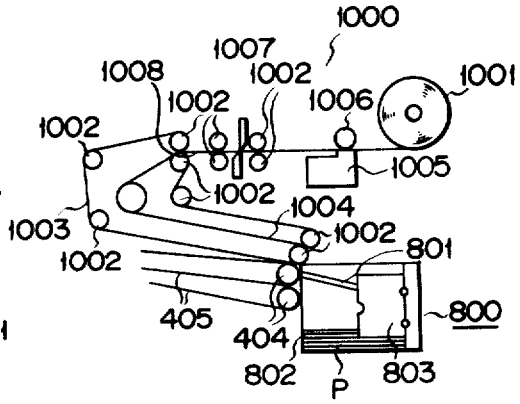
FIG. 9 is a plan view of a construction of a sorting card preparing section of the FIG. 1 embodiment.

The unit sheet-stack bundling section 600 for bundling the normal sheets, as shown in FIGS. 6 and 7, is comprised of a pair of rotatory drums 601 (disposed in parallel at the rear side in FIG. 6), a sheet transfer mechanism 602, a sheet-stack looping/bundling mechanism 603. Disposed at the lower portion of the back-up member 524 of the sorting/collecting section 500, the rotatory drums 601 and 601 receive a given number of sheets P transferred in substantially horizontal state by the back-up member 524, that is, the sheet-stack P1 after it is sorted, and rotates it by approximately 90° counterclockwise, i.e. in an arrow J direction, thereby to make it disposed vertically. That is, the respective rotatory drums 601 and 601 are so designed that those are shaped substantially square with a given thickness and are mounted to a shaft 604 at given intervals. When the shaft 604 is rotated by a drive source (not shown), the drums are rotated in the arrow direction J. Fixing plates 605 and inverse L shaped movable holding plates, or clamp members 606, upstand on the peripheral surfaces of the drums 601 and 601. The clamp members 606, so designed as to open and close in the arrow direction K, opens when the unit sheet-stack P1 is to be received, and closes when the unit sheet-stack P1 is received, whereby the unit sheet-stack P1 is clamped in the stacking direction by means of the fixing plate 605 and the clamp member 606. The rotatory drums 601 and 601 are coupled with the horizontal section of the back-up member 524 in a telescopic manner, when the back-up member 524 descends from the unit sheet-stack forming device.

The unit sheet-stack shift mechanism 602 divides the unit sheet-stack P1 disposed by the rotatory drums 601 and 601 into first and second sub-unit sheet-stacks at the central portion of the unit sheet-stack as viewed in the stacking direction. Then, the mechanism transfers or shifts the divided ones to the bundling tape loop forming/bundling mechanism. The unit sheet-stack shift mechanism 602 is comprised of a pushing member 607, a dividing plate 608, a guide wall 609, and a feed arm 610. The pushing member 607 is coupled with the drive section 613, through a push bar 611 and an arm 612. When the drive section 613 is operated, the pushing member 607 moves in the arrow direction L, through the arm 612 and the push bar 611. The pushing member 607 pushes the unit sheet-stack P1 substantially vertically clamped on the drums 601 and 601 along the fixed bottom plate 614 and the movable bottom plate 615 till the stack reaches the guide wall 609. The pushing member 607, the fixed bottom plate 614, and the movable bottom plate 615 are divided into three and, of those, the pushing member 607 and the fixing bottom plate 614 are telescoped with the rotatory drums 601 and 601 (FIG. 7).

A movable bottom plate 615, as required, rotates about the axis 616 as a fulcrum. A partition plate 608 shaped like a fan is used for bisecting the sheet-stack P1 vertically placed on the movable bottom plate 615. Specifically, the partition plate 608 is disposed above the movable bottom plate 615 and is coupled with a drive section (not shown) through a shaft 617 and swings downwardly when required to be inserted into the sheet-stack P1 to bisect the sheet-stack. The edge part 608*a* of the partition plate 608, facing the movable bottom plate 615, is shaped like a blade. The same is coupled with a drive stage 619 through a feed belt 618. Accordingly, when the drive stage 619 operates, the feed arm is driven through the belt 618 to move in an arrow M direction, i.e. to the left in FIG. 7, so that the sheet-stack P1 on the movable bottom plate 615 is fed to the sheet-stack loop forming/bundling mechanism 603 along the guide wall 609. The guide wall 609 and the feed arm 610 are trisected and interrelated with one another in a telescopic manner.

The bundling loop forming/bundling mechanism 603 turns the free end portion of the bundling tape fed from the bundling tape supply source by a given number of turns thereby to form a bundling tape loop. Within the loop, the free end of the tape is suspended so as to divide the space within the loop into two sections. Into the bundling loop, the unit sheet-stack P1 is inserted by means of the unit sheet-stack shift mechanism 602 thereby to push up the loop to bundle the unit sheet-stack. The bundling loop forming/bundling mechanism 603 is provided on the left end portion (FIG. 7) of the sheet-stack shifting mechanism 602. The bundling tape wound around a reel 620 of the tape supplier, for example, a green paper tape 621 (a yellow paper tape is used for the soiled unit sheet-stack bundling) is led to a tape guide path 623 through a tape guide roller 622. In the middle way of the guide path 623, the paper tape 621 is nipped by a pair of tape feeding rollers 624 and 625 and is fed forward. The guide path 623 and the feeding rollers 624 and 625 are provided on a roller supporting member 626. The roller supporting member 626 rotates in the arrow direction N about the shaft 625*a* of the feeding roller 625, if necessary. The feeding rollers 624 and 625 are rotated by the drive source not shown.

Rotatably supported by the shaft 625*a*, a pad drive arm 627 is swung in an arrow C direction when required. A rotating paste pad 628 is provided at the end of the arm 627. the paste pad 628 for pasting the tape 621 contacts a roller 629 provided near the pad when moving thereby to effect the pasting. The roller 629 is dipped at the peripheral surface in a paste holder 630.

An outlet portion (leading end) of a tape guide path 623 has a cutter 631 for cutting a tape 621. A pad stopper 632 for stopping the paste pad 628 is provided on a roller support table 626 in front of the cutter 631. Provided above the roller support table 626, an arc shaped squeeze-roller drive arm 634 when necessary is rotated about a shaft 633 as a fulcrum in a direction of an arrow N. A roller arm 635, rotatably supported at an end of the roller drive arm 634, swings within a given range. Additionally, a rotatable squeeze roller 636 is provided at one end of the arm 635. The squeeze roller 636 squeezingly presses one end of the tape pasted and cut against the tape wound around the sheet-stack P1.

On the forward portion of the roller supporting member 626, or on the right side in FIG. 6, a tape guide member 637 is provided into which the leading end of the tape 621 fed by the feeding rollers 624 and 625 is inserted by a given length thereof. A pair of unit sheet-stack guides 638 and 638 provided in parallel on both sides of the guide member 637 are used for guiding the unit sheet-stack P1 transferred by the transfer arm 610. These guide members 637, 638 and 638 are fixed to a guide member drive disc 649 and are rotated in the arrow direction Q or moved in the arrow direction R as required by means of the disc 649. A pair of clamp drive arms 639 and 639 are disposed above the guide members 637 and 638 (FIG. 7) in the form substantially conversing toward the left side. At the ends of those arms 639 and 639, pairs of clamp bars 640, 640, 641 and 641 are suspended in parallel at given intervals. The arms 639 and 639, coupled at the rear ends or the left ends in FIG. 7, with the drive section 642, are opened and closed in the arrow direction S by means of the drive section 642, if necessary. At the time closing, the unit sheet-stack P1 transferred by the feeding arm 610 is clamped by the pairs of the clamp bars 640 and 640, and 641 and 641.

In FIGS. 6 and 7, reference numeral 643 designates a tape insertion preventive plate shaped like an inverse U. The preventive plate 643 is provided at the portion corresponding to the ends of the sheet guide members 638 and 638, substantially upright. Reference numeral 644 in FIGS. 6 and 7 indicates a base member of the apparatus. A portion 645 enclosed by a two-dot chain line indicates a portion where the respective components 621 to 636 in FIG. 6 are located.

The operation of the normal unit sheet-stack bundling device 600 will be described. The rotatory drums 601 and 601 are normally at a standstill in a state that the fixing plate 605 and the clamp member 606 are displace upwardly, waiting the receiving of the unit sheet-stack P1. At this time, the clamp members 606 are in a closed condition. Under this condition, if the back-up member 524 bearing the unit sheet-stack (including 100 sheets stacked, for example) descends, the clamp member 606 corresponding to the back-up member 524 opens for receiving the sheet-stack, as shown in FIG. 5. The back-up member 524 further descends and temporarily stops when the horizontal portion of the back-up member 524 is telescoped with the rotatory drums 601 and 601. In this way, the unit sheet-stack P1 on the back-up member 524 is transferred onto the peripheral surfaces of the rotatory drums 601 and 601. When the unit sheet-stack P1 is transferred to the rotatory drum 601, the clamp member 606 is closed to clamp the unit sheet-stack P1 and the drums 601 and 601 start to rotate in the arrow direction J, while at the same time the back-up member 524 ascends. When the rotatory drums 601 and 601 are rotated by about 90 degrees clockwise, the rotatory drums 601 and 601 temporarily stop thereat and the clamp member 606 opens again. At this time, the lower end surface of the unit sheet-stack P1 is directed substantially horizontally with respect to the fixed bottom plate 614. And the unit sheet-stack P1 is transferred onto the bottom plate 614, with the sheets being disposed substantially vertically. In this way, the unit sheet-stack P1 received from the back-up member 524 while being substantially in horizontal state is rotated by about 90° in the arrow direction J to be postured substantially vertically. In this way, the rotatory drums 601 and 601 stop the rotation and the clamp member 606 opens. Succeedingly, the drive section 613 operates with the result that the pushing member 607 advances in the arrow direction L to push the unit sheet-stack on the fixed bottom plate 614 to come in contact with the guide wall 609. At this position, the pushing member 607 temporarily stops. Accordingly, the pushed unit sheet-stack P1 is positioned on the movable bottom plate 615 in the substantial vertical posture, as shown in FIG. 7.

When the pushing member 607 temporarily stops (or when the pushing member 607 starts to advance), the bundling loop forming/bundling mechanism 603 starts the bundling loop formation. The construction and operation of the bundling loop forming/bundling mechanism 603 will be described referring FIGS. 8A through 8I. Conventionally a roller receiving member 626, a paste pad 628, a squeeze roller 636, a tape guide member 637, unit sheet-stack guide members 638 and 638, and clamp bars 640, 640, 641 and 641 are stopped in the state shown in FIG. 8, or in the state of FIGS. 6 and 7, and is ready for the start of the operation. Under this condition, when the bundling loop formation command is issued, the roller receiving member 626 rotates clockwise as shown in FIG. 8 and the outlet (end) of the guide path 623 temporarily stops at the position facing the inlet of the tape guide member 637. When the roller receiving member 626 stops, the feeding rollers 624 and 625 rotate in the tape feeding direction, so that the tape 621 is fed and the leading end portion of the tape is inserted into the guide member 637 by the given length, as shown in FIG. 8. When the leading end portion of the tape is inserted into the tape guide member 637, the receiving member 626 rotates counterclockwise, as shown in FIG. 8 to return to the original position, and the feeding rollers 624 and 625 rotate again to feed the tape 621. At this time, the disc 649 rotates in the arrow direction Q while at the same time the tape guide member 637 and the unit sheet-stack guides 638 and 638 rotate. Then, when the guide members 637, 638 and 638 are postured substantially vertically as shown in FIG. 8, the rotation and the tape 621 feeding are stopped. As described above, one end of the tape 621 fed by the feeding rollers 624 and 625 is wound by about two turns, as shown in FIG. 8 and the leading end portion 621*a* of the tape is suspended in the space defined by the loop so as to divide the space into two sections. After the tape loop is thus previously formed, the loop waits the unit sheet-stack P1 fed by the arm 610. The bundling loop 646 is formed on the right side portion of the tape insertion preventive plate 643, as shown in FIG. 7.

Once the bundling loop 646 is formed, the dividing plate 608 swings about the fulcrum of the shaft 617 downwardly. At this time, the dividing plate is inserted into the center of the thickness of the unit sheet-stack P1 substantially vertically postured on the movable bottom plate 615, so that the unit sheet-stack P1 is divided into two sub-unit sections by the dividing plate 608. When the stack is divided, the pushing member 607 retracts by a distance corresponding to the thickness of the dividing plate 608 thereby to facilitate the insertion of the dividing plate 608 to the unit sheet-stack P1. The dividing plate 608 temporarily stops, being inserted within the unit sheet-stack P1. In this way, when the dividing plate 608 stops within the unit sheet-stack P1, the feeding arm 610 advances in the arrow direction M and feeds the unit sheet-stack P1 divided on the movable bottom plate 615, while holding it, along the guide wall 609 in the arrow direction M. At this time, the pushing member 607 retracts (moves to the right in FIG. 6) to return to the original position to stop thereat. At this time, the rotatory drums 601 and 601 close the clamp member 606 to clamp the next unit sheet-stack and to rotate by 90° and repeats the above-mentioned operation. In this way, the divided unit sheet-stack P1 fed by the feeding arm 610 (FIG. 7) is guided by the unit sheet-stack guide members 638 and 638 and the left portion in FIG. 7 is stopped at the position where it is inserted into the bundling loop 646, as shown in FIGS. 7 and 8. At this stage, the tape guide member 637 is inserted between the sub-unit sheet-stacks divided, as shown in FIG. 8. At this time, the dividing plate 608 swings upwardly to retract from the unit sheet-stack P1 to return to the original position and stop thereat.

When the unit sheet-stack P1 is inserted at the leading end into the bundling loop 646, and the dividing plate 608 returns to the original position, the tape guide member 637 and the unit sheet-stack guide members 638 and 638 retracts (moves to the left in FIG. 7), together with the disc 649, and goes into the drive section 642 in FIG. 7. At this time, the tape pull-in preventive plate prevents the bundling loop 646, as well as the guide members 637, 638 and 638, from being pulled in. The free end 621*a* of the tape suspended in the inner space of the bundling loop 646 is positioned between the first and second sub-unit sheet-stacks divided (see FIG. 8E). When the respective guide members 637, 638 and 638 retard, the drive arms 639 and 639 perform the closing operation, so that the unit sheet-stack P1 is nipped by the clamp bars 640 and 640, and 641 and 641 to be clamped. Therefore, the leading end portion 621*a* of the tape is inserted into the unit sheet-stack P1, as shown in FIG. 8. At this time, the feeding arm 610 retracts, or moves to the right to return to the original position and stop thereat. When the unit sheet-stack P1 is clamped by the clamp bars 640 and 640, and 641 and 641, the feeding rollers 624 and 625 rotates in the reverse direction to that in which the feeding rollers 624 and 625 feed the tape, so that the tape 621 is retracted to squeeze the bundling loop 646, as shown in FIG. 8. Upon the completion of the squeezing of the loop, the arm 627 rotates counter-clockwise and the pasting pad 628 revolves and rotates, as shown in FIG. 8, so that the tape 621 is pasted at the pad receiving member 632. Following the pasting of the tape, the pasting pad returns to the original position.

In this way, when the pasting work for the tape 621 is completed, the arm 634 rotates clockwise and the squeezing roller 636 moves, as shown in FIG. 8, so that the roller 636 comes in contact with the corner of the unit sheet-stack to push the tape 621. At this time, the cutter 631 operates to cut the tape 621. Then, squeeze roller 636 rotates downwardly on the tape wound around the unit sheet-stack P1 with the rotation of the arm 634, while pressing the tape. Through this rotation of the squeeze roller, and end portion of the tape which is pasted and cut is fastened onto the tape wound around the unit sheet-stack P1 and forcibly presses the tape. In this way, the unit sheet-stack P2 bundled by the tape 621 is obtained. The unit sheet-stack in this state will be called a bundled unit sheet-stack P2. When the pasting and squeezing operations by the squeezing roller are completed, the movable bottom plate 615 (FIG. 7) opens, as indicated by a two-dot chain line and the arms 639 and 639 are also opened. Upon this, the clamp for the bundled unit sheet-stack by the clamp bars 640, 640, 641 and 641 is released and the bundled unit sheet-stack P2 falls naturally and is guided to the bundled unit sheet-stack classifying device 650 located under the bundling device. When the bundled unit sheet-stack P2 drops to the classifying device 400, the squeezing roller 636 returns to the original position, as shown in FIG. 8, and the guide members 637, 638 and 638 which have been pulled in the drive portion 642 advances to return to the state shown in FIG. 7. Then, the disc 649 rotates again in the arrow direction Q and the respective guide members 637, 638 and 638 also rotate, as shown in FIG. 8 and return to the original position and then prepare for the net bundling loop forming operation.

During the course of taking out the bundled sheet-stacks or the bundled unit sheet-stack P2 along a take-out path 650, a stamping means (not shown) stamps the name of an operator, the date of sheet processing on the strip (portion with the tape 621 wound). Following the stamping, the sheet-stack bundling apparatus separately disposed from the sorting apparatus bundles the sheet-stacks for each 10 sheet-stacks.

The sheet-invalidating section 700 constitutes a cutting machine to cut the soiled sheets transferred through the soiled sheet transfer path 403*b* sheet by sheet. The cutting machine is commercially available and one of them now being marked is a SHREDDER (trade name) manufactured and sold by Meiko Shokai Co., Ltd. in Japan. Evidentally, any type machine or means is applicable for the sheet invalidating section of the sheet-like material sorting machine of the present invention, if it is able to invalidate the security of the soiled sheet. For example, the soiled sheet may be melted by a chemical process or burned for its invalidation.

A detector 411 detects the soiled sheets sorted by the second sorting gate 408 to count this to check the number of the soiled sheets sorted by the second sorting gate 408. A to-be-rejected sheet collecting section 800, as described above, collects the to-be-rejected sheet guided to the second transfer path 402.

An operating section 900 is comprised of a console 901 provided on the sorting apparatus and a keyboard 902 provided on the console 901. The keyboard 903 is provided with a total number display 903, a to-be-rejected sheet number display 904, ten keys 905 and a start switch 906. The total number display 903 displays the total number of the soiled and normal sheets of each unit sheet-stack. The display 904 displays the number of the to-be-rejected sheets of the unit sheet-stack which is the result of subtraction of the total number from 100. The ten keys 905 are provided for inputting the information necessary for the control unit to be described later. The start switch 906 is a switch for starting the operation of the sorting apparatus. Upon the operation of the start switch, the supply section 100 operates to supply the bundled sheet-stacks P as the sheet-like material to be sorted.

The sorting card preparing section 1000 prepares the sorting card in response to the read signal from the read mechanism 104 and the print information from the control unit. In the sorting card preparing section 1000, a thermal sensitive paper 1001 is transferred through a transfer path 1004 having rollers 1002 and a belt 1003. In the midway of the transfer path, necessary print is made by a thermal head 1005 to prepare the sorting card. A drive pushing roller 1006 presses the thermal sensitive sheet 1001 against the thermal head 1005. The cutter 1007 cuts the thermal sheet 1001 printed with given lengths. The transfer path 1004 extends to above the end of the terminal portion of a second transfer path 402 and is used for transferring the sorting card 1008 prepared from the upper portion of a collecting box 802. A guide member 801 is comprised of a pair of rod like members spaced each other. The width of the sorting card 1008 is shorter than the interval between those rod like members. Accordingly, the rod like members never interferes the take-in of the sorting card 1008.

In the supply section 100, when the sheet-stack P is placed on the read table 108, the name of an operator and the date of the sheet processing and the like are read out by the read mechanism 104. The read data by the read mechanism 104 is transferred to a thermal head 1005. The thermal head 1005 prints on the thermal sensitive sheet 1001 the information read from the strip T fed by the read mechanism 104 and the result of the sorting of the sorting sheet-stack P of which the information of the strip is read, for example, the number of soiled sheets and the number of normal sheets. The thermal sheet 1001 is then transferred by the roller 1002 and cut into segments with given lengths by the cutter 1007. Those segments are sent out as sorting cards. The sorting cards 1008 are transferred to the collecting section 800 by the transfer path 1004 and is collected together with the to-be-rejected sheets.

With respect to the timing that the sorting card 1008 is collected in the collecting section 802, when the sorting of the sheet-stack corresponding to the sorting card 1008 prepared is completed, and the to-be-rejected sheets in the sheet-stack P are collected in the collecting section 802, those are collected on the to-be-rejected sheets. Therefore, it is surely recognized every 100 sheets that the to-be-rejected sheets under the sorting card but above the other sorting card 1008 relate to the sorting cards 1008. Note here that there is no need for stopping the operation of the sorting apparatus even when the information of the to-be-rejected sheets of 100 is computed and recorded.

Figure 10A:
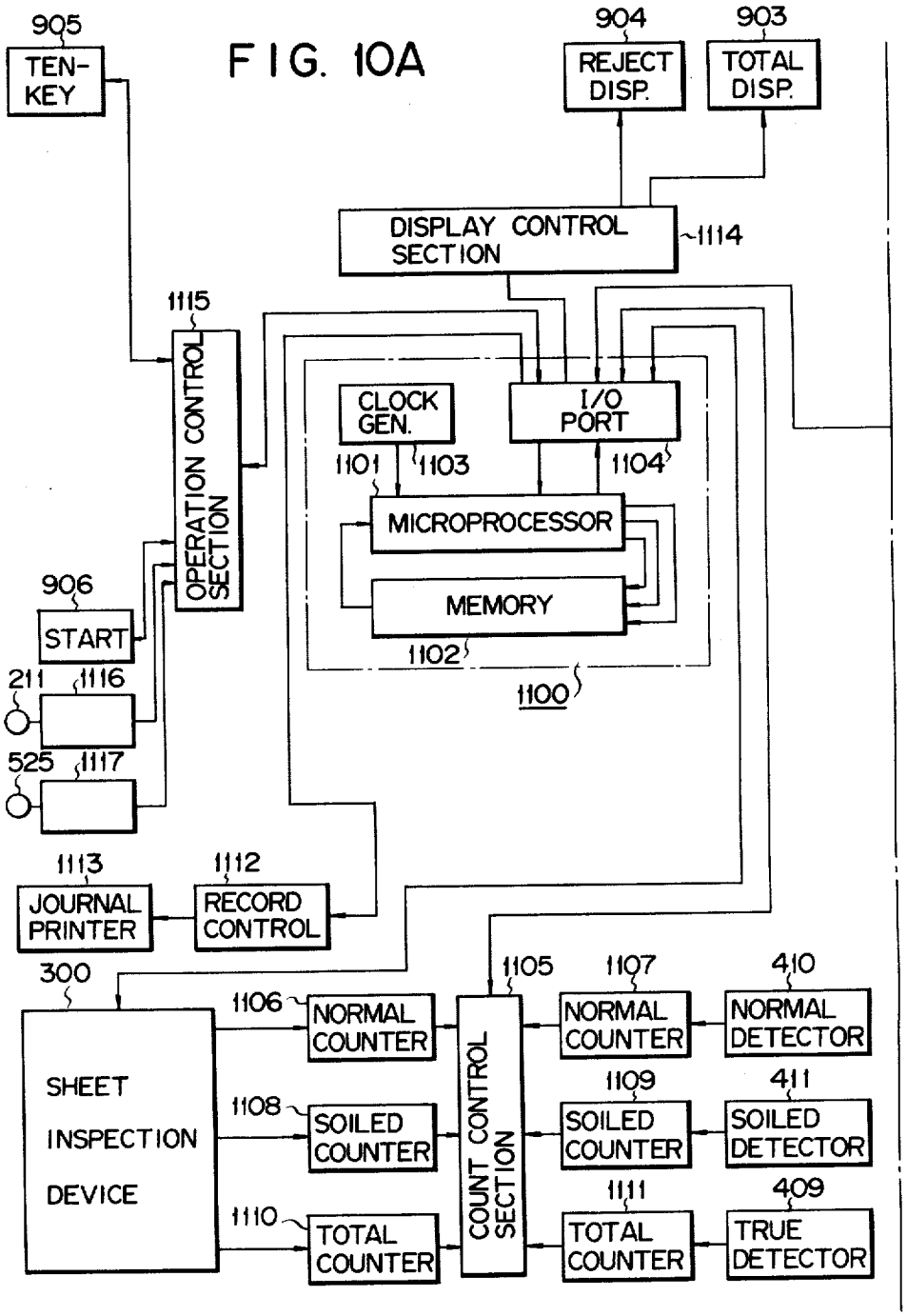
FIGS. 10A and 10B cooperate to form a block diagram of a circuit construction of a control unit of the FIG. 1 embodiment.
Figure 10B:
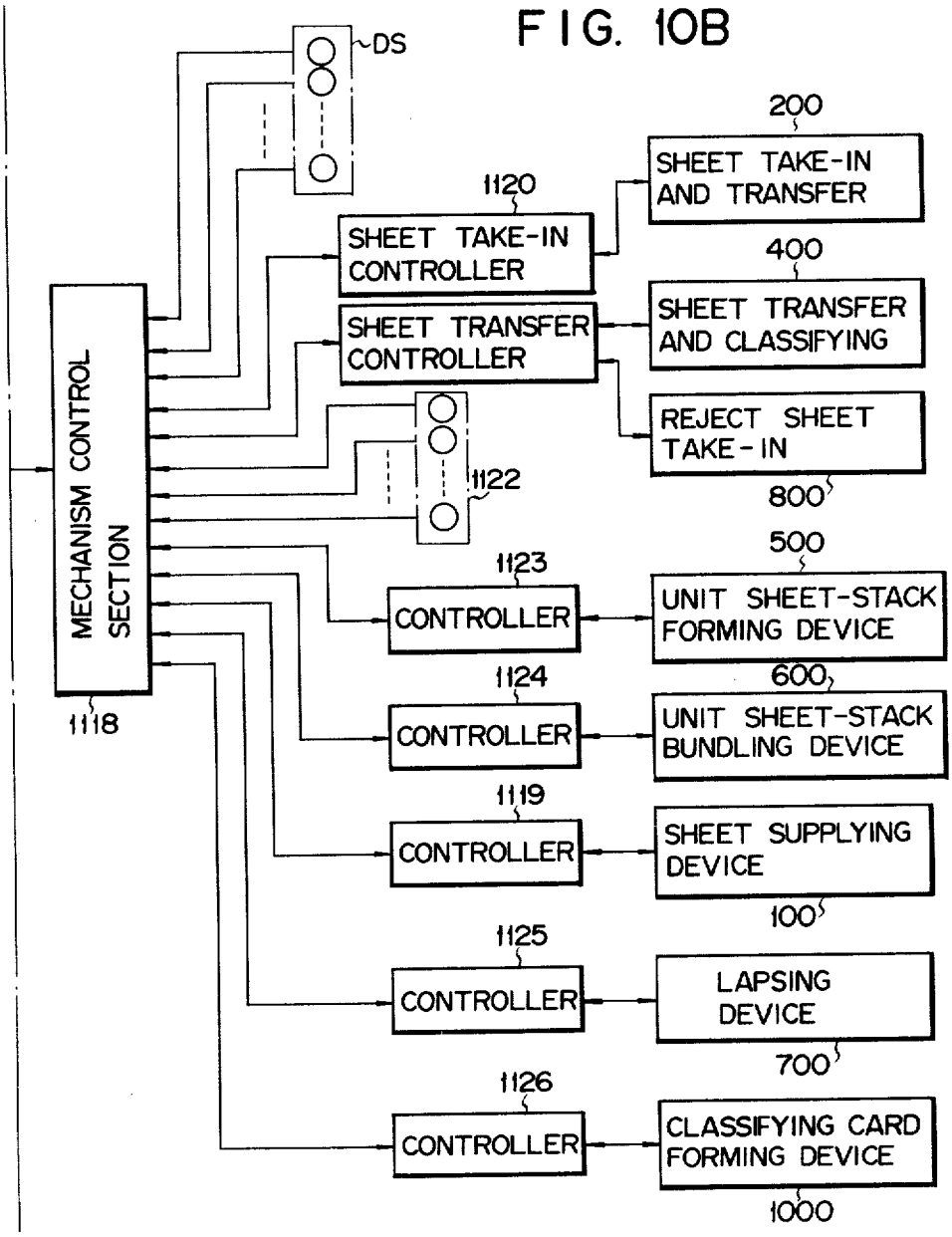

FIGS. 10A and 10B cooperate to show a block diagram of the control unit.

The main control unit 1100 is comprised of a microprocessor 1101, a memory 1102, a clock generator 1103 and an input/output port 1104. The main control unit 1100 is connected to the inspecting section 300 shown in FIG. 4 and to a counter control unit 1105 which further connected to normal sheet counters 1106 and 1107, soiled sheet counters 1108 and 1109, and total counters 1110 and 1111. Supplied with the signals representing the normal sheet, the soiled sheet and the total number of those sheets produced from the inspecting section 300, the counters 1106, 1108 and 1110 respectively count the number of the normal and soiled sheets and the total number of those sheets, and produces the contents of the counters to the counter control unit 1105. The output signals from the normal sheet detector 410, the soiled sheet detector 411 and the total number sensor 409 in FIG. 1 are respectively supplied to the counters 1107, 1109 and 1111 where the numbers of the soiled and normal sheets and the total number of those sheets are counted. The contents of these counters are applied to the control section 1105. In the control unit 1105, the contents of the counters 1106, 1108 and 1110 are compared with those of the counters 1107, 1109 and 1111. In those comparisons, if even a single noncoincidence is found, the counter control unit 1105 applies a noncoincident signal to the main control unit 1100 thereby to stop the operation of the sorting apparatus and to prevent erroneous counting. The counter control unit 1105 transfers the contents of the respective counters 1106 to 1111 to the main control unit 1100 every time the 100 sheets are processed. The main control unit 1100 is connected to a record control unit 1112 which is further connected to a journal printer 1113 for printing out the contents of the processing.

The main control unit 1100 is connected to a display control unit 1114 and an operation control unit 1115. The display control unit 1114 is connected to the sheet number display 903 and 904 of the operating unit 900 in FIG. 2. The operation control unit 1115 is connected to a start switch 906 of the operating unit 900 in FIG. 2 and sheet kind setting signal generators 1116 and 1117 which respond to the signals from the sheet kind setting dials 211 and 525 shown in FIG. 1. The main control unit 1100 is connected to a mechanism control unit 1118. The mechanism control unit 1118 is connected to door switches Ds, Ds, . . . , in FIG. 1, a supply control section 1119 to control the supply section 100, a take-out/transfer control unit 120 for controlling the take-out/transfer device 200, a transfer/sorting control section 1121 for controlling the transfer/sorting unit 400, and the to-be-rejected sheet collecting device 800, and a plurality of jam detectors 1122.

The jam detectors 1122 are disposed along the transfer path of the transfer/sorting section 400. The mechanism control section 1118 is connected to a sorting/collecting control unit 1123 for controlling the sorting/collecting section 500, a bundling control unit 1124 for controlling the bundling section 600, an invalidation control unit 1125 for controlling the sheet invalidating section 700, and a sorting card preparing control unit 1126 for controlling the sorting card preparing section 1000.

The control unit thus constructed is accommodated within a rack 1127 under the sorting apparatus shown in FIG. 1. The microprocessor 1101 of the main control unit 1100 is capable of effecting 8-bit parallel processing, for example, and effects the control operation in accordance with a program stored in a memory 1102 such as a read only memory of IC.

The operation of the control unit will be described hereinafter.

(1) The sheet-stacks P are set in the supply section 100 in a manner that the sheet-stacks P, while upstands, are set on the bundle supply table 101.

(2) Upon the operation of the start switch 906, the pins 106 of the table 101 advances, so that the frontal sheet-stack P is released from the pressure of the plate spring 107. Then, the direction changing mechanism (not shown) sets the frontal sheet-stack P on the read table 108 horizontally.

(3) The read mechanism 104 reads the information recorded on the small strip T of the sheet-stack P to produce a read signal for application to the bundle supply table through the supply control unit 1119, the mechanism control unit 1118 and the sorting card control unit 1126.

(4) The small strip T of the sheet-stack P is broken by the strip breaking mechanism 103 and only the sheet-stack P is transferred to the take-out/transfer section 200.

(5) The sheets of the sheet-stack P fed are taken out sheet by sheet.

(6) During the course of the transfer, the sheet-stack P is inspected by the inspecting unit 300 and the result of the inspection is applied to the counters 1106, 1108 and 1110 where it is counted, and at the same time to the transfer/sorting section through the mechanism control unit 1118, the transfer/sorting control unit 1121, whereby the sorting gates 406 and 408 are driven.

(7) The sheets P are sorted by the sorting gates 406 and 408 into the normal sheets and to-be-rejected sheets which are in turn led to the second transfer path 402 and the third transfer path 403 and finally are to the sorting-/collecting section 500, the invalidating section 700, and the to-be-rejected sheet collecting section 800. After the sorting, the normal and soiled sheets are detected by the detectors 409, 410 and 411 and the detected signals are counted by the normal sheet counter 1107, the soiled sheet counter 1109 and the total number counter 1111. The counts of the counters are applied to the counter control unit 1105. The counter control section 1105 effects the comparison as mentioned above.

(8) The normal sheets are bundled every 100 sheets by the bundling apparatus 600 and are taken out into the take-out path 650 where those are stamped.

(9) The soiled sheets are transferred to the invalidating section 700 for their invalidation.

(10) The to-be-rejected sheets are collected by the section 800.

(11) Upon the completion of these sorting, the total number and the number of the to-be-rejected sheets are displayed on the displays 903 and 904, respectively.

The data representing the numbers of the normal and soiled sheets, and the total number of those sheets are applied through the count control unit 1105, the main control unit 1100 and the record control unit 1112 to the journal printer 1113 where those are printed out. The counts are simultaneously applied to the mechanism control unit 1118 and the sorting card preparing section 1000. The section 1000 prints out the numbers of the normal and soiled sheets of each unit sheet-stack of 100 sheets sorted on basis of the read data from the read mechanism 104 and the counts and copies the record information on the small strip T, whereby the sorting card 1008 is prepared. The sorting cards 1008 are collected by the collecting box 802 through the transfer path 1003.

(12) When the sorting of the 100 sheets P is completed (actually, the take-out operation in the take-out section 202 is completed), the next sheet-stack P is supplied by the supply section 100 and is continuously sorted.

As seen from the foregoing description, the sorting apparatus according to the invention can reliably check the number of the sheets of the sheet-stack of 100 sheets, and presence or absence of the normal, soiled and to-be-rejected sheets. Accordingly, it can find what sheet-stack of those 10 stacks has an abnormal sheet or sheets. Accordingly, it is possible to readily know who handled the sheet-stack having the abnormal sheet. Therefore, there is no need for inserting the sorting card by stopping the apparatus every 100 sheets, unlike the conventional apparatus: That is, the sorting cards are automatically prepared. Therefore, even if the sheets are processed every 100 sheets, little reduction of the processing ability is brought about. And the load of the operator is reduced for the apparatus operation. The above description made relating to processing the sheet-like material of the securities is correspondingly applicable for the processing of the other kinds of the sheet-like material such as slips. Further change and modification of the invention are allowed within the scope of the invention.

What we claim is:

1. A sheet sorting apparatus including:
   - a supply means for supplying sheets to be sorted;
   - a take-out unit for sequentially taking out the sheets supplied by said supply means sheet by sheet;
   - an inspection unit for judging the taken out sheets to permit sorting to be effected into first and second sheets;
   - a sorting unit for sorting the sheets on the basis of the result of judgement by said inspection unit; and
   - a collecting unit for collecting the sorted sheets, the improvement comprising:
   - a read-out unit for reading out the bundled portion of bundled sheets supplied to the supply means, said bundled sheets being comprised of a predetermined number of sheets; and
   - a card preparing unit for preparing a sorting card according to read out data of the read-out unit so that when sorting is completed with respect to the bundled predetermined number of sheets the bundled predetermined number of sheets can be collected, together with said second sheets, at the collecting unit.

2. A sheet sorting apparatus comprising:
   - supply means for supplying bundled sheets, said supply means having read-out means for reading out a bundled portion of the bundled sheets;
   - a take-out/transfer unit for sequentially transferring the sheets supplied by the supply means sheet by sheet;

an inspection unit for detecting the sheets transferred by the take-out/transfer unit for performing a necessary inspection of them and for judging the sheets as reusable normal sheets, nonreusable soiled sheets or reject sheets;

a transfer/sorting unit for sorting the sheets on the basis of the result of the judgement effected by the inspection unit;

a normal sheet sorting/collecting unit, soiled sheet sorting/collecting unit and reject sheet sorting-/collecting unit for sorting the sheets transferred by the transfer/sorting unit into said normal sheets, said soiled sheets and said reject sheets, respectively, and collecting them as such;

a sheet bundling unit for bundling the normal sheets collected at said normal sheet sorting/collecting unit;

a transfer unit for transferring a bundle of normal sheets from said sheet bundling unit;

an invalidating unit for invalidating the soiled sheets collected at said soiled sheet sorting/collecting unit;

sorting card preparing means for receiving a read-out signal from the read-out means in said supply means and for preparing a sorting card, said sorting card being collected, together with the reject sheets, at said reject sheet sorting/collecting unit when sorting is completed with respect to a predetermined number of sheets; and a control unit for controlling said supply means, said take-out/transfer unit, said inspecting unit, said transfer/sorting unit, said respective sorting/collecting units, said sheet bundling unit, said transfer unit, said invalidating unit, and said sorting card preparing means.

3. A sheet sorting apparatus comprising:

supply means for supplying bundled sheets, said supply means having read-out means for reading a bundled portion of the bundled sheets;

a take-out and transferring/transfer unit for sequentially taking out the sheets supplied by said supply means sheet by sheet;

an inspecting unit for detecting the sheets transferred by said take-out/transfer unit, for effecting a necessary inspection of them and for judging them as reusable normal sheets, nonreusable soiled sheets or reject sheets;

a transfer/sorting unit for sorting the sheets on the basis of the result of judgement effected by said inspecting unit;

a normal sheet sorting/collecting unit, soiled sheet sorting/collecting unit and reject sheet sorting-/collecting unit for sorting the sheets transferred by said transfer sorting unit into said reusable normal sheets, said nonreusable soiled sheets and said reject sheets and collecting them as such;

a sheet bundling unit for bundling the normal sheets collected at the normal sheet sorting/collecting unit;

a transfer unit for transferring the bundle of normal sheets from said sheet bundling unit;

sorting card preparing means for receiving a read-out signal from said read-out means in said supply means and for preparing a sorting card, said sorting card being collected, together with said reject sheets, at said reject sheet sorting/collecting unit when sorting is completed with respect to a predetermined number of sheets; and a control unit for controlling said supply means, said take-out/transfer unit, said inspecting unit, said transfer/sorting unit, said respective sorting/collecting units, said sheet bundling unit, said transfer unit, and said sorting card preparing means.

4. A sheet sorting apparatus comprising:

supply means for supplying bundled sheets, said supply means having read-out means for reading out a bundled portion of the bundled sheets;

a take-out/transfer unit for sequentially transferring the sheets supplied by said supply means sheet by sheet;

an inspecting unit for detecting the sheets transferred by said take-out/transfer unit, for effecting a necessary inspection of them and judging them as reusable normal sheets, nonreusable soiled sheets or reject sheets;

a transfer/sorting unit for sorting the sheets on the basis of the result of judgement effected by said inspecting unit;

a normal sheet sorting/collecting unit, a soiled sheet sorting/collecting unit and a reject sheet sorting-/collecting unit for sorting the sheets transferred by said transfer/sorting unit into the normal sheets, soiled sheets and reject sheets, respectively, and collecting them as such;

a sheet bundling unit for bundling said normal sheets collected at said normal sheet sorting/collecting unit;

a transfer unit for transferring a bundle of normal sheets from said sheet bundling unit;

an invalidating unit for invalidating the soiled sheets collected at said soiled sheet sorting/collecting unit;

sorting card preparing means for receiving a read-out signal from said read-out means in said supply means and for preparing a sorting card, said sorting card being collected, together with said reject sheets, at said reject sheet sorting/collecting unit when sorting is completed with respect to a predetermined number of sheets;

a control unit for controlling said supply means, said take-out/transfer unit, said inspecting unit, said transfer/sorting unit, said respective sorting/collecting units, said sheet bundling unit, said transfer unit, said invalidating unit, and said sorting card preparing means; and a console unit for supplying necessary data to said control unit.

5. A sheet sorting apparatus comprising:

supply means for supplying bundled sheets, said supply means having read-out means for reading out a bundled portion of said bundled sheets;

a take-out/transfer unit for sequentially transferring the sheets supplied by said supply means sheet by sheet;

inspecting means for detecting the sheets transferred by said take-out/transfer unit, for effecting a necessary inspection of them and for judging them as reusable normal sheets, nonresuable soiled sheets or reject sheets;

a transfer/sorting unit for sorting the sheets on the basis of the result of judgement effected by said inspecting means;

a normal sorting/collecting unit, soiled sheet sorting-/collecting unit and reject sheet sorting/collecting unit for sorting the sheets transferred by said transfer/sorting unit into normal sheets, soiled sheets and reject sheets;

a sheet bundling unit for bundling said normal sheets collected by said normal sheet sorting/collecting unit;

a transfer unit for transferring a bundle of normal sheets from said sheet bundling unit;

a sorting card preparing means for receiving a read-out signal from said read-out means in said supply means and for preparing a sorting card, said sorting card being collected, together with said reject sheets, at said reject sheet sorting/collecting unit when sorting is completed with respect to a predetermined number of sheets;

a control unit for controlling said supply means, said take-out/transfer unit, said inspecting means, said transfer/sorting unit, said respective sorting/collecting units, said sheet bundling unit, said transfer unit, said invalidating unit, and said sorting card preparing means; and a console unit for supplying necessary data to said control unit.

6. A sheet sorting apparatus according to claim 1, 2, 3, 4 or 5 in which said read-out means comprises a lamp for illuminating the bundled portion of said bundled sheets and an image sensor for receiving light reflected from the bundled portion of said bundled sheets.

7. A sheet sorting apparatus according to claim 1, 2, 3, 4 or 5 in which said sorting card preparing means comprises a heat-sensitive paper, a roller and belt combination for transferring said heat-sensitive paper, and a thermal head for printing data on the heat-sensitive paper.

8. A sheet sorting apparatus according to claim 4 or 5, in which said console unit comprises an operation table, and a keyboard having a total number display unit, a reject sheet number display unit, ten keys and start switch.

9. A sheet sorting apparatus according to claim 6, in which said image sensor comprises a charge coupled device.

* * * * *